US012612773B2

(12) United States Patent
Matsumura et al.

(10) Patent No.: US 12,612,773 B2
(45) Date of Patent: Apr. 28, 2026

(54) FLUSH TOILET

(71) Applicant: TOTO LTD., Fukuoka (JP)

(72) Inventors: Koichiro Matsumura, Fukuoka (JP); Takumi Tsuchitani, Fukuoka (JP); Kenichi Nakamura, Fukuoka (JP); Hiroshi Hashimoto, Fukuoka (JP); Chisato Sone, Fukuoka (JP); Shinichi Urata, Fukuoka (JP); Daisuke Yamamoto, Fukuoka (JP); Koichi Motooka, Fukuoka (JP); Kenji Hatama, Fukuoka (JP)

(73) Assignee: Toto Ltd., Fukuoka (JP)

( * ) Notice: Subject to any disclaimer, the term of this patent is extended or adjusted under 35 U.S.C. 154(b) by 170 days.

(21) Appl. No.: 18/779,213

(22) Filed: Jul. 22, 2024

(65) Prior Publication Data

US 2025/0043561 A1 Feb. 6, 2025

(30) Foreign Application Priority Data

Jul. 31, 2023 (JP) ..... 2023-124753
Jul. 31, 2023 (JP) ..... 2023-124754
(Continued)

(51) Int. Cl.
*E03D 1/30* (2006.01)
*E03D 1/34* (2006.01)
(Continued)

(52) U.S. Cl.
CPC ..... *E03D 1/30* (2013.01); *E03D 1/34* (2013.01); *E03D 1/38* (2013.01); *E03D 11/13* (2013.01);
(Continued)

(58) Field of Classification Search
CPC E03D 1/28; E03D 1/286; E03D 1/012; E03D 1/30; E03D 1/142; E03D 2201/30; E03D 11/02; E03D 11/13; E03D 11/18
See application file for complete search history.

(56) References Cited

U.S. PATENT DOCUMENTS 728,624 A * 5/1903 Schuh ..... E03D 1/286 4/250
6,502,251 B1 1/2003 Teshima et al.
(Continued)

FOREIGN PATENT DOCUMENTS

JP S59151982 U 10/1984
JP H02035132 A 2/1990
(Continued)

OTHER PUBLICATIONS

Official Action of JP Pat. Appln. No. 2023-124755 dated Aug. 27, 2025 (english translation).
(Continued)

*Primary Examiner* — Erin Deery
(74) *Attorney, Agent, or Firm* — BakerHostetler

(57) ABSTRACT

A siphon jet flush toilet comprises: a bowl; a rim spout port suppling flush water to the bowl; a discharge trap conduit; a jet spout port spouting flush water toward an inlet of the discharge trap conduit; a reservoir tank including a jet spouting discharge valve and storing flush water; a jet water conduit configured to guide the flush water in the reservoir tank to the jet spout port; and a controller being configured to control a rim spouting in which the flush water is spouted from the rim spout port and a jet spouting in which the flush water is spouted from the jet spout port, wherein the jet spouting discharge valve includes a valve body, the valve body being arranged at a position that is lower than an upper surface of the bowl and higher than a seal water level, and
(Continued)

before opening the jet spouting discharge valve, the flush water is supplied to the jet water conduit.

19 Claims, 15 Drawing Sheets

(30) Foreign Application Priority Data

Jul. 31, 2023 (JP) ..... 2023-124755
Jul. 31, 2023 (JP) ..... 2023-124756

(51) Int. Cl.
*E03D 1/38* (2006.01)
*E03D 11/11* (2006.01)
*E03D 11/13* (2006.01)
*E03D 11/18* (2006.01)

(52) U.S. Cl.
CPC ..... *E03D 11/18* (2013.01); *E03D 11/11* (2013.01); *E03D 2201/30* (2013.01)

(56) References Cited

U.S. PATENT DOCUMENTS

| | | | |
|---|---|---|---|
| 2007/0061955 | A1 | 3/2007 | Asada et al. |
| 2012/0284910 | A1 | 11/2012 | Shirakawa et al. |
| 2018/0080208 | A1 | 3/2018 | Hashimoto et al. |
| 2020/0102728 | A1 | 4/2020 | Miyake et al. |
| 2023/0065471 | A1 | 3/2023 | Tanimoto et al. |
| 2023/0066417 | A1 | 3/2023 | Hashimoto et al. |
| 2023/0069634 | A1 | 3/2023 | Tanimoto et al. |
| 2023/0183960 | A1 | 6/2023 | Sun et al. |

FOREIGN PATENT DOCUMENTS

| | | | |
|---|---|---|---|
| JP | H03090746 | A | 4/1991 |
| JP | H05-339969 | | 12/1993 |
| JP | H07180202 | A | 7/1995 |
| JP | H10-219785 | | 8/1998 |
| JP | 2003147841 | A | 5/2003 |
| JP | 2004100182 | A | 4/2004 |
| JP | 2004-251020 | | 9/2004 |
| JP | 2005-155136 | | 6/2005 |
| JP | 2005336796 | A | 12/2005 |
| JP | 2006291451 | A | 10/2006 |
| JP | 2007-308908 | | 11/2007 |
| JP | 2009091813 | A | 4/2009 |
| JP | 2012-202121 | | 10/2012 |
| JP | 2012-202122 | | 10/2012 |
| JP | 2012237125 | A | 12/2012 |
| JP | 5180295 | B2 | 1/2013 |
| JP | 2016-125342 | | 7/2016 |
| JP | 2019210728 | A | 12/2019 |
| JP | 2020-051218 | | 4/2020 |
| JP | 2021131002 | A | 9/2021 |
| JP | 2023-032962 | | 3/2023 |
| JP | 2023-032964 | A | 3/2023 |
| JP | 2023032963 | A | 3/2023 |
| TW | 201814112 | A | 4/2018 |
| TW | 202321548 | A | 6/2023 |
| WO | 2001023678 | A1 | 4/2001 |
| WO | 2005/085538 | | 9/2005 |

OTHER PUBLICATIONS

Official Action of JP Pat. Appln. No. 2023-124753 dated Aug. 19, 2025 (english translation).
Decision to Grant of JP Pat. Appln. No. 2023-124754 dated Aug. 27, 2025 (english translation).
Decision to Grant for JP Pat. Appln. No. 2023-124756 (English Translation).
Decision to Grant for JP Pat. Appln. No. 2023-124753 (English Translation).
Japanese Official Action issued on Jul. 22, 2025 (with English translation).

* cited by examiner

FIG. 4A

LARGE FLUSH

| | EARLY RIM SPOUTING | MIDDLE RIM SPOUTING | LATE RIM SPOUTING | TOTAL |
|---|---|---|---|---|
| SPOUTING TIME | 1.9s | 2.4s | 6.1s | 10.4s |
| RIM SPOUTING | 0.41L | 0.52L | 1.32L | 4.56L |
| JET SPOUTING | | 2.31L | | |

FIG. 4B

SMALL FLUSH

| | EARLY RIM SPOUTING | MIDDLE RIM SPOUTING | LATE RIM SPOUTING | TOTAL |
|---|---|---|---|---|
| SPOUTING TIME | 1.4s | 1.7s | 7.6s | 10.7s |
| RIM SPOUTING | 0.31L | 0.37L | 1.64L | 3.82L |
| JET SPOUTING | | 1.50L | | |

STANDBY

UPON REACHING DWL

WHEN SUPPLYING WATER TO TANK

STANDBY

UPON REACHING DWL

WHEN SUPPLYING WATER TO TANK

FLUSH TOILET

CROSS-REFERENCE TO RELATED APPLICATIONS

This application claims the benefit of Japanese Patent Application No. 2023-124754 filed on Jul. 31, 2023, Japanese Patent Application No. 2023-124753 filed on Jul. 31, 2023, Japanese Patent Application No. 2023-124755 filed on Jul. 31, 2023, and Japanese Patent Application No. 2023-124756 filed on Jul. 31, 2023, which Japanese Patent Applications are hereby incorporated by reference in their entirety for all purposes as if fully set forth herein.

BACKGROUND OF THE INVENTION

Field of the Invention

The present invention relates to a flush toilet and, in particular, to a siphon jet flush toilet.

Description of the Related Art

Conventionally, for example, as described in Japanese Patent No. 5180295, a siphon jet flush toilet in which water is directly supplied to a rim spout port from tap water and flush water is guided by head pressure to a jet spout port from a low-height reservoir tank is known. In addition, as described in Japanese Patent Laid-Open No. 2023-32964, a siphon jet flush toilet in which early rim spouting, middle rim spouting, and late rim spouting are continuously performed and jet spouting is performed during middle rim spouting (sequential control) is also known.

In the flush toilet according to Japanese Patent No. 5180295 described above, since the tank is arranged so as to have a low silhouette and jet spouting is to be guided to a jet water conduit by head pressure of flush water inside the tank, a space exists between a valve body of a discharge valve and a water level of the jet water conduit (=seal water level), and since air inside the space flows out from the jet spout port when an opening operation of the discharge valve of the tank is performed and flush water is supplied to the jet water conduit, a pressure loss occurs due to the outflow of air.

In addition, even in the flush toilet according to Japanese Patent Laid-Open No. 2023-32964, a pressure loss occurs due to the outflow of air from the jet spout port in a similar manner to the flush toilet according to Japanese Patent No. 5180295.

The present invention has been made in order to solve the problems (issues) faced by conventional art and an object thereof is to provide a siphon jet flush toilet capable of reducing a pressure loss which occurs due to air existing between a jet discharge valve and a jet water conduit flowing out from a jet spout port.

SUMMARY OF THE INVENTION

In order to achieve the object described above, the present invention provides a siphon jet flush toilet, comprising: a bowl including a waste receiving surface and a rim formed along a top edge portion of the waste receiving surface; a rim spout port formed in the rim, the rim spout port spouting flush water to the bowl; a discharge trap conduit connected to a bottom portion of the bowl, the discharge trap conduit including an ascending conduit that extends upward from the bottom portion of the bowl, a descending conduit that extends downward from the ascending conduit, and a top portion that is positioned between the ascending conduit and the descending conduit and that regulates a seal water level; a jet spout port arranged in the bottom portion of the bowl so as to spout flush water toward an inlet of the discharge trap conduit; a reservoir tank including a jet spouting discharge valve, the reservoir tank storing flush water to be supplied to the jet spout port; a jet water conduit being configured to connect the reservoir tank and the jet spout port, the jet water conduit guiding the flush water in the reservoir tank to the jet spout port due to head pressure of the flush water in the reservoir tank; and a controller being configured to control a rim spouting in which the flush water is spouted from the rim spout port and a jet spouting in which the flush water is spouted from the jet spout port, wherein the jet spouting discharge valve including a valve body, the valve body being arranged at a position that is lower than an upper surface of the bowl and higher than the seal water level, and before opening the jet discharge valve, the flush water is supplied to the jet water conduit so as to reduce air that exists between the valve body of the jet spouting discharge valve and a water surface of the jet water conduit.

According to the present invention configured in this manner, since the flush water is supplied to the jet water conduit to reduce air that exists between the jet spouting discharge valve and an upper part of the jet water conduit before opening the jet spouting discharge valve, the pressure loss which occurs due to the air flowing out from the jet spout port when the flush water is supplied from the reservoir tank to the jet water conduit can be reduced.

In the present invention, preferably, the controller controls flush water to be sequentially and successively spouted from the rim spout port as "early rim spouting", "middle rim spouting", and "late rim spouting" and to be spouted from the jet spout port as "jet spouting" when "middle rim spouting" is being performed.

In the present invention configured in this manner, since sequence control performed so that flush water is sequentially and successively spouted from the rim spout port as "early rim spouting", "middle rim spouting", and "late rim spouting" and to be spouted from the jet spout port as "jet spouting" when "middle rim spouting" is being performed causes flush water supplied to the bowl by the early rim spouting and pooled water remaining in the bowl due to the late rim spouting during a previous flush to join flush water due to jet spouting, a siphon action can be generated due to flush water with a large flow rate flowing into the discharge trap conduit and the siphon action can be continued by flush water due to subsequent jet spouting and flush water due to subsequent middle rim spouting. As a result, according to the present invention, even with a low silhouette in which flush water in the reservoir tank is supplied to the jet water conduit due to head pressure of the flush water, waste can be reliably discharged by a strong siphon action and water conservation can be achieved.

In the present invention, preferably, after flush water is supplied to the jet water conduit, a water level of the jet water conduit rises to a vicinity of the jet spouting discharge valve, and air is exhausted, the controller performed an opening operation of the jet spouting discharge valve is performed.

According to the present invention configured in this manner, since the opening operation of the jet discharge valve is performed after a water level of the jet water conduit rises to a vicinity of the jet spouting discharge valve and air is exhausted, a pressure loss due to air can be reduced when flush water is spouted from the jet spout port.

In the present invention, preferably, a spouting time of the early rim spouting is shorter than a spouting time of the late rim spouting.

According to the present invention configured in this manner, the bowl can be flushed by the early rim spouting of which a flush water amount is smaller than the late rim spouting and a siphon action can be generated by the flush water.

In the present invention, preferably, the controller executes a water supply operation to the reservoir tank or an opening operation of the jet spouting discharge valve during a flush operation so that a tank water level in the reservoir tank is at a higher position than a water level of a pooled water surface of the bowl.

According to the present invention configured in this manner, since the controller executes a water supply operation to the reservoir tank or an opening operation of the jet spouting discharge valve during a flush operation so that a tank water level in the reservoir tank is constantly at a higher position than a water level of the pooled water surface of the bowl, even when waste becomes clogged, wastewater can be prevented from flowing backward from the bowl to the tank.

In the present invention, preferably, when the water level of the bowl rises, the controller performs an opening operation of the jet discharge valve so that a flow rate of the flush water being discharged from the reservoir tank is reduced.

According to the present invention configured in this manner, since an opening operation of the jet spouting discharge valve is performed so that the flow rate of the flush water that is drained from the reservoir tank is reduced when the water level of the bowl rises due to clogging of waste or the like, the water level in the reservoir tank becomes less apt to drop and becomes higher than the water level of the bowl and, accordingly, a backward flow can be prevented.

In the present invention, preferably, an air exhaust pipe extending higher than a stopped water level in the reservoir tank from lower than the valve body of the jet discharge valve is further provided.

According to the present invention configured in this manner, the air exhaust pipe can effectively exhaust air remaining between the jet spouting discharge valve and a water surface of the jet water conduit. Furthermore, since the air is exhausted from the air exhaust pipe into the reservoir tank and air which flows out to a seal water surface (pooled water surface) of the bowl as air bubbles can be reduced, a flush is not adversely affected by the air bubbles.

In the present invention, preferably, flush water is spouted from the rim spout port to raise the water level of the bowl so that flush water is supplied to the jet water conduit before the controller performs an opening operation of the jet discharge valve of the reservoir tank.

According to the present invention configured in this manner, since flush water is spouted from the rim spout port to raise the water level of the bowl so that the flush water is supplied to the jet water conduit before an opening operation of the j et spouting discharge valve of the reservoir tank is performed, the bowl can be flushed with the flush water spouted from the rim spout port and flush water can be supplied to the jet water conduit utilizing the fact that the water level of the bowl is raised by the flush water after the flush. Furthermore, since the flush water in the bowl can be used, water conservation can also be achieved. In addition, since flush water is supplied from the bowl to the jet water conduit, air more readily escapes from the exhaust pipe and, as a result, a smaller amount of air bubbles are exhausted to the bowl and the air bubbles become less conspicuous to a user.

In the present invention, preferably, a total spouting time of the early rim spouting and the middle rim spouting is shorter than the spouting time of the late rim spouting.

According to the present invention configured in this manner, a siphon action can be generated and continued by the early rim spouting and the middle rim spouting of which a flush water amount is smaller than flush water due to the late rim spouting together with jet spouting.

In the present invention, preferably, the stopped water level of flush water in the reservoir tank is set higher than the upper surface of the bowl.

According to the present invention configured in this manner, since the stopped water level (WL0) of the flush water in the reservoir tank is set higher than the upper surface of the bowl, large head pressure can be produced.

In the present invention, preferably, the stopped water level of flush water in the reservoir tank is set lower than the upper surface of the bowl.

According to the present invention configured in this manner, since the stopped water level (WL0) of the flush water in the reservoir tank is set lower than the upper surface of the bowl, the height of the reservoir tank can be lowered and a lower silhouette can be achieved.

In the present invention, preferably, specific gravity of the jet spouting discharge valve ranges from 1.2 to 1.4.

According to the present invention configured in this manner, since the specific gravity of the jet spouting discharge valve ranges from 1.2 to 1.4 and is larger than specific gravity of water of 1, even when the water level of the bowl rises and a state is created where the water level in the tank is nearly in equilibrium with the water level of the bowl, the jet discharge valve closes by its own weight and wastewater can be prevented from flowing backward from the bowl into the reservoir tank.

In the present invention, preferably, a water level of flush water during standby in the reservoir tank is set higher than the upper surface of the bowl.

According to the present invention configured in this manner, since the water level of flush water during standby in the reservoir tank is set higher than the upper surface of the bowl, the water level of the bowl during standby never becomes higher than the water level of the flush water in the reservoir tank and a backward flow can be prevented.

In the present invention, preferably, an instantaneous flow rate of flush water that is discharged from the reservoir tank is lowered by setting a pull-up time of the jet discharge valve to a predetermined fixed value.

According to the present invention configured in this manner, since the instantaneous flow rate of the flush water that is discharged from the reservoir tank becomes lower when a water level difference between the water level of the bowl and the water level of the reservoir tank decreases by setting the pull-up time of the jet spouting discharge valve to a predetermined fixed value, the water level in the reservoir tank becomes less apt to drop and becomes higher than the water level of the bowl and, accordingly, wastewater can be prevented from flowing backward from the bowl into the reservoir tank.

In the present invention, preferably, seal water with a predetermined seal water level is formed in a lower part of the bowl, the flush toilet further comprises a detecting device configured to detect the seal water position, the jet spout port is positioned in the seal water, and when the seal water position is lower than the predetermined seal water level, the flush water is replenished to the bowl to raise the seal water position and jet spouting is performed in this state.

For example, when a large amount of waste is discharged while being clogged and a siphon action is broken after the flush water is replenished to the reservoir tank, the seal water position may become lower. When a jet flows out from the jet spout port in a state where the seal water position has become lower, air trapped in the jet water conduit is ejected from the jet spout port and water splashing occurs in which the air pushes out flush water.

According to the present invention, when the seal water position is lower than the predetermined seal water level, since the flush water (seal water) is replenished to the bowl to raise the seal water position and jet spouting is performed in this state, a situation where air trapped in the jet water conduit is ejected from the jet spout port and water splashing occurs in which the air pushes out flush water can be prevented.

In the present invention, preferably, the detecting device detecting the seal water position is a tank water level detecting device detecting a water level of the reservoir tank, and the seal water position is estimated based on a value of a dead water level detected by the tank water level detecting device, a value of the stopped water level, or a water supply time to the reservoir tank required to reach the stopped water level.

According to the present invention configured in this manner, since the seal water position is estimated using existing tank water level detecting device, there is no need to newly provide a sensor for detection or the like.

In the present invention, preferably, the tank water level detecting device is a float switch detecting a stopped water level of the reservoir tank.

According to the present invention configured in this manner, since the seal water position is estimated using an existing float switch, there is no need to newly provide a sensor for detection or the like.

In the present invention, preferably, the seal water is replenished by performing rim spouting before performing jet spouting.

According to the present invention configured in this manner, the bowl surface of the bowl can be flushed by performing rim spouting before jet spouting and, furthermore, flush water due to the rim spouting can be used to replenish the seal water.

In the present invention, preferably, an overflow pipe configured to discharge the flush water in the reservoir tank to the jet water conduit when a water supply time to the reservoir tank required by the water level of the reservoir tank to rise to the stopped water level becomes prolonged is further provided in the reservoir tank, wherein seal water is replenished by replenishing the flush water in the reservoir tank and causing the flush water to flow out from the overflow pipe to the jet water conduit.

According to the present invention configured in this manner, since the seal water can be replenished using the existing overflow pipe, a mechanism for replenishing the seal water can be simplified.

With the siphon jet flush toilet according to the present invention, a pressure loss which occurs due to air existing between the jet spouting discharge valve and the jet water conduit flowing out from the jet spout port can be reduced.

BRIEF DESCRIPTION OF THE DRAWINGS

FIG. 4A is a table showing spouting times and spouted water amounts of "early rim spouting", "middle rim spouting", "late rim spouting", and "jet spouting" in a large flush of the flush toilet according to the embodiment of the present invention;

FIG. 4B is a table showing spouting times and spouted water amounts of "early rim spouting", "middle rim spouting", "late rim spouting", and "jet spouting" in a small flush of the flush toilet according to the embodiment of the present invention;

DETAILED DESCRIPTION OF THE INVENTION

Hereinafter, a flush toilet according to an embodiment of the present invention will be described with reference to the drawings.

Figure 1:
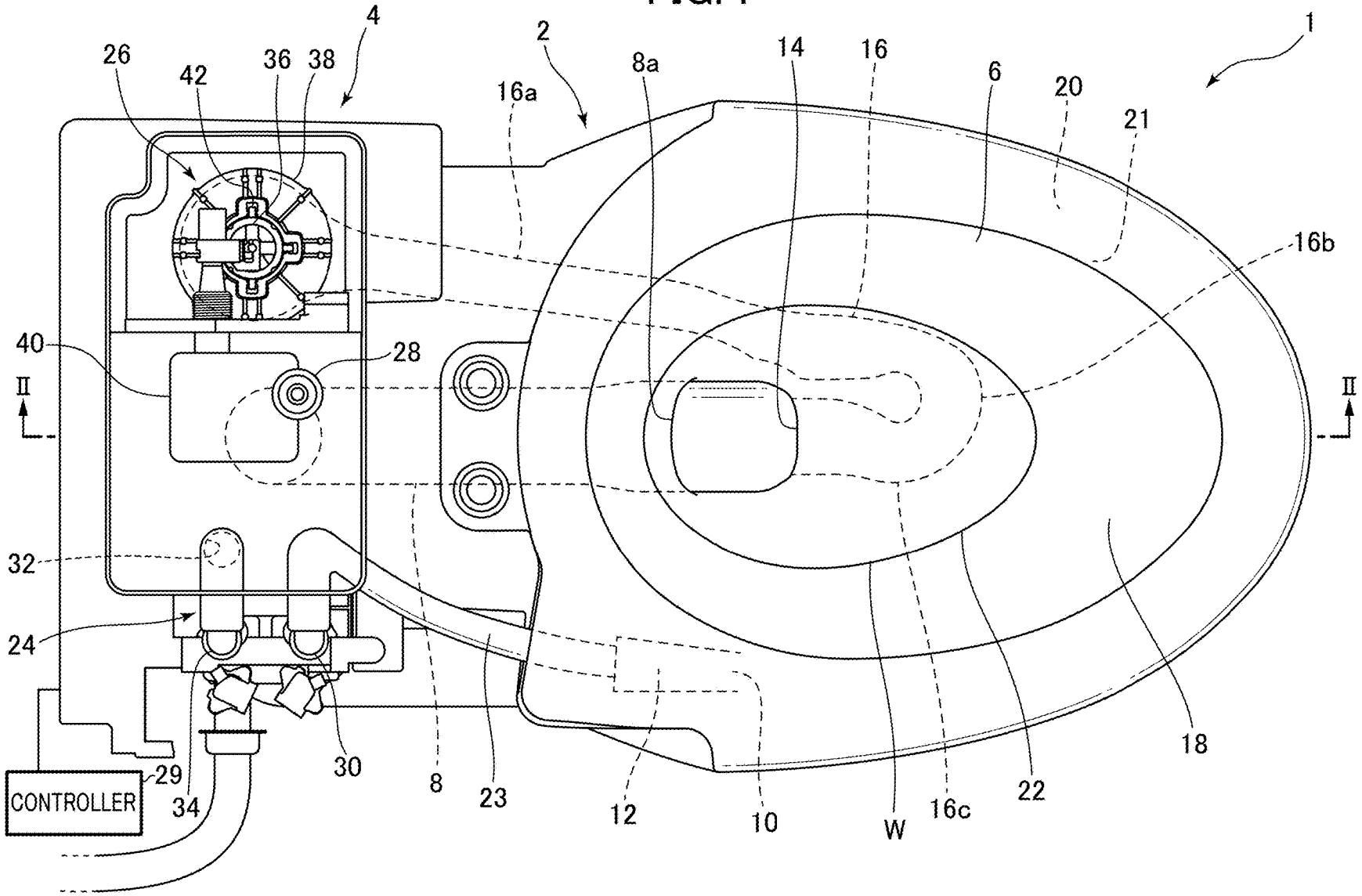
FIG. 1 is a plan view showing a flush toilet according to an embodiment of the present invention.

First, a basic structure of the flush toilet according to the present embodiment will be described with reference to FIGS. 1 and 2. FIG. 1 is a plan view showing the flush toilet according to the embodiment of the present invention and FIG. 2 is a side sectional view taken along line II-II in FIG. 1.

Figure 2:
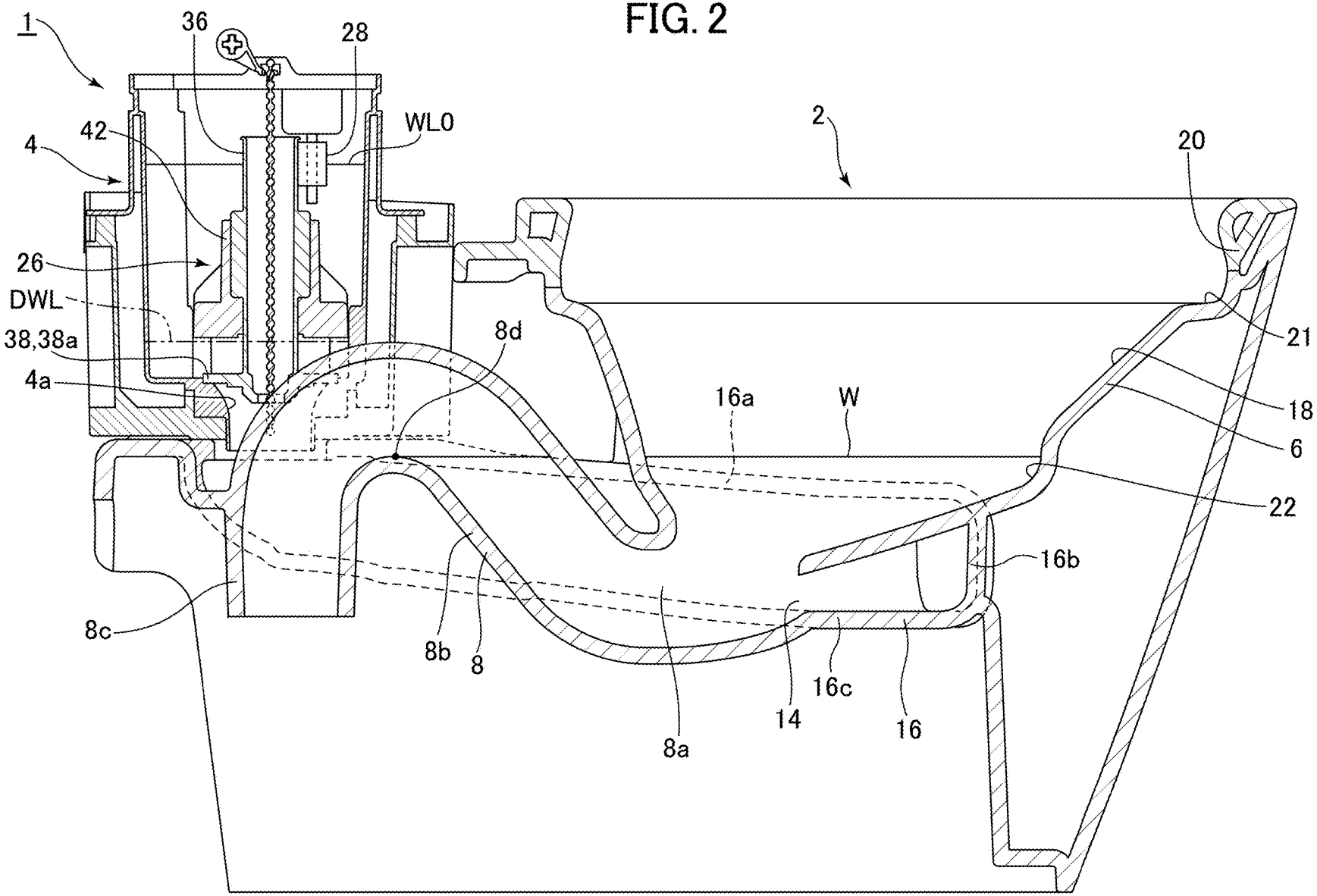
FIG. 2 is a side sectional view taken along line II-II in FIG. 1.

As shown in FIGS. 1 and 2, a flush toilet 1 according to the present embodiment is a siphon jet flush toilet. The flush toilet 1 includes a ceramic toilet main body 2, a resin toilet seat and a resin toilet lid (not illustrated) which are arranged on an upper surface of the toilet main body 2, and a reservoir tank 4 which is arranged in an upper part to the rear of the toilet main body 2 and which is covered by a resin cover (not illustrated).

Formed in the toilet main body 2 are a bowl 6 which receives waste, a discharge trap conduit 8 which is provided in a bottom portion of the bowl 6 for discharging waste by a siphon action, a rim spout port 10 which performs rim spouting, a rim conduit 12 for guiding flush water to the rim spout port 10, a jet spout port 14 which performs jet spouting, and a jet water conduit 16 for guiding flush water to the jet spout port 14.

The bowl 6 includes a bowl-like waste receiving surface 18, a rim 20 formed along a top edge portion of the bowl 6, and a shelf 21 formed between the waste receiving surface 18 and the rim 20. In addition, the bowl 6 is equipped with a well portion 22 which is formed in a region below the waste receiving surface 18 and which is connected to the discharge trap conduit 8. A seal water surface (pooled water surface) W is formed inside the well portion 22.

The discharge trap conduit 8 includes an inlet 8*a*, an ascending conduit 8*b* which extends upward from the inlet 8*a*, a descending conduit 8*c* which extends downward from the ascending conduit 8*b*, and a top portion 8*d* which is positioned between the descending conduit 8*c* and the ascending conduit 8*b* and which regulates a seal water level of the seal water surface W.

In this case, a lower end of the descending conduit 8*c* of the discharge trap conduit 8 is connected via a discharge socket (not illustrated) to a water discharge pipe (not illustrated) which is attached to a floor or a wall.

The rim spout port 10 is formed at the rear on the left side of the rim 20 when the toilet main body 2 is viewed from the front. The rim spout port 10 spouts flush water toward the front and the flush water flows down to the waste receiving surface 18 while circulating on an inner circumference surface of the rim 20 and a shelf surface of the shelf 21 to flush the waste receiving surface 18.

The rim conduit 12 is formed in a tapered shape of which a flow channel cross section gradually decreases toward the rim spout port 10. A water supply hose 23 which is directly connected to tap water is connected to an upstream side of the rim conduit 12. Flush water is supplied from the tap water to the rim conduit 12 and the flush water is to be spouted from the rim spout port 10 due to water supply pressure of the tap water.

The jet spout port 14 is formed in the bottom portion of the bowl 6. The jet spout port 14 is arranged so as to oppose the inlet 8*a* of the discharge trap conduit 8 and is oriented toward the inlet 8*a* of the discharge trap conduit 8. The jet spout port 14 spouts flush water toward the inlet 8*a* of the discharge trap conduit 8 and the flush water flows into the discharge trap conduit 8 and starts a siphon action.

The jet water conduit 16 includes an upstream flow channel 16*a* which extends forward from the reservoir tank 4, a bending flow channel 16*b* which bends from the upstream flow channel, and a downstream flow channel 16*c* which extends rearward from the bending flow channel and which connects to the jet spout port 14. Flush water is supplied from the reservoir tank 4 to the jet water conduit 16 and the flush water is to be spouted from the jet spout port 14 due to head pressure of the flush water.

The reservoir tank 4 is a tank adopting a gravity supply system which stores flush water to be used for jet spouting and which supplies the flush water to the jet spout port 14. The reservoir tank 4 stores flush water up to a stopped water level (WL0) and flush water from the stopped water level to a dead water level (DWL) is to be used for jet spouting. The reservoir tank 4 is a small resin tank. A lower part of the reservoir tank 4 is arranged lower than an upper surface of the rim 20 of the toilet main body 2 and higher than the top portion 8*d* of the discharge trap conduit 8. Accordingly, the flush toilet 1 is a low silhouette type toilet.

A water supply device 24 which supplies flush water into the reservoir tank 4, a discharge device 26 which supplies or stops supplying the flush water stored in the reservoir tank 4 to the jet water conduit 16, and a float switch 28 which detects a state where a water level of the flush water in the reservoir tank 4 has reached the stopped water level (WL0) are provided in the reservoir tank 4. In addition, a controller 29 which controls the water supply device 24 and the discharge device 26 so as to be driven or stopped based on an operation signal of a user and an operation unit (not illustrated) which transmits an operation signal according to an operation by the user are provided outside the reservoir tank 4.

The water supply device 24 includes a fixed flow rate valve (not illustrated) connected to tap water, a rim-side electromagnetic valve 30 which supplies or stops supplying flush water to the rim spout port 10, and a tank-side electromagnetic valve 34 which supplies or stops supplying flush water to a tank water supply port 32 arranged in the reservoir tank 4. The rim-side electromagnetic valve 30 and the tank-side electromagnetic valve 34 are configured to be driven by a command of the controller 29 based on an operation signal of the user or a water level detection signal by the float switch 28.

The discharge device 26 includes an overflow pipe 36 which discharges overflowing water in the reservoir tank 4 to the toilet main body, a jet spouting discharge valve 38 which is fixed to a lower end portion of the overflow pipe 36, and a toilet washing unit 40 which opens and closes the jet spouting discharge valve 38 by moving the overflow pipe 36 up and down using an electrical driving force. Upper and lower ends of the overflow pipe 36 are opened and overflowing water in the reservoir tank 4 is to be discharged to the jet water conduit 16. A guiding member 42 which guides upward and downward movement of the jet spouting discharge valve 38 is attached to a periphery of a discharge port 4*a* of the reservoir tank 4. The toilet washing unit 40 is configured to be driven by a command of the controller 29 based on an operation signal of the user.

While the flush toilet 1 is a low silhouette type toilet as described above, more specifically, as shown in FIG. 2, a valve body 38*a* of the jet spouting discharge valve 38 is arranged at a position which is lower than the upper surface of the bowl 6 (upper surface of the rim 20) and higher than the seal water level.

In addition, as shown in FIG. 2, the stopped water level (WL0) of the reservoir tank 4 is set higher than the upper surface of the rim 20 of the bowl 6. Note that as a modification, the stopped water level may be set lower than the upper surface of the rim 20 of the bowl 6.

The controller 29 is electrically connected to the operation unit, the float switch 28, the rim-side electromagnetic valve 30, the tank-side electromagnetic valve 34, and the toilet washing unit 40 and is capable of transmitting and receiving various signals. The controller 29 is configured to receive a flush start signal of a large flush or a small flush from the operation unit and to drive or stop driving the rim-side electromagnetic valve 30, the tank-side electromagnetic valve 34, and the toilet washing unit 40 based on a flush sequence stored in advance.

Figure 3:
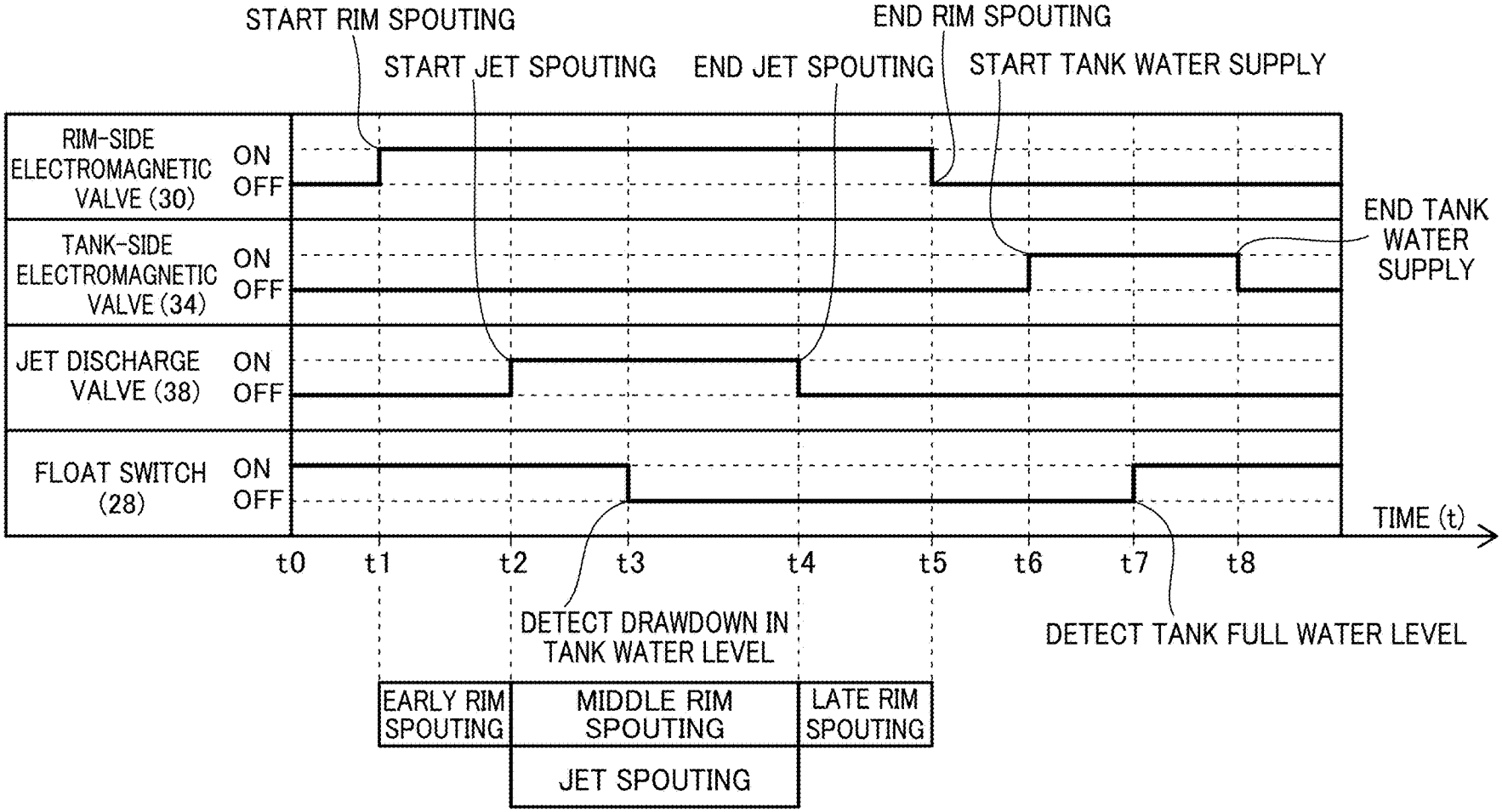
FIG. 3 is a time chart showing "rim spouting", "tank water supply", "jet spouting", and a "tank water level" in the flush toilet according to the embodiment of the present invention.

Next, "rim spouting", "tank water supply", "jet spouting", and a "tank water level" in the flush toilet 1 according to the present embodiment will be described with reference to FIG. 3. FIG. 3 is a time chart showing "rim spouting", "tank water supply", "jet spouting", and a "tank water level" in the flush toilet according to the embodiment of the present invention.

In this case, "rim spouting" refers to spouting flush water from the rim spout port 10, "tank water supply" refers to supplying water to the reservoir tank 4, "jet spouting" refers to spouting flush water from the jet spout port 14, and the "tank water level" refers to a water level of the flush water in the reservoir tank 4.

As shown in FIG. 3, in the event of a large flush of the flush toilet 1, first, when the user operates the operation unit after a standby state of time t0, at time t1, the rim-side electromagnetic valve 30 is turned on and rim spouting is started in which water is supplied to the rim conduit 12 and flush water is spouted from the rim spout port 10. The rim spouting is continuously performed until time t5.

Next, at time t2, the jet spouting discharge valve 38 is opened and turned on and jet spouting is started in which the flush water in the reservoir tank 4 is spouted from the jet spout port 14 via the jet water conduit 16. The jet spouting ends at time t4. Rim spouting is concurrently performed while the jet spouting is being performed from time t2 to time t4.

As is apparent from FIG. 3, for convenience's sake, the rim spouting from time t1 at which the rim spouting is started to time t2 at which the jet spouting is started will be referred to as "early rim spouting", the rim spouting from time t2 to time t4 during which the jet spouting is being performed will be referred to as "middle rim spouting", and the rim spouting from time t4 at which the jet spouting ends until time t5 at which the rim spouting ends will be referred to as "late rim spouting". In addition, as described above, "jet spouting" is being performed from time t2 to time t4.

Next, as shown in FIG. 3, while the float switch 28 has been turned on at time t2 at which the jet spouting is started since the water level of the flush water in the reservoir tank 4 is the stopped water level, at subsequent time t3, the float switch 28 is turned off since the water level of the flush water in the reservoir tank 4 becomes lower than the stopped water level. The off-state of the float switch 28 continues until time t7.

In addition, at time t6, the tank-side electromagnetic valve 34 is opened and turned on, tank water supply to the reservoir tank 4 is started, and the tank water supply ends at time t8. Due to the start of the tank water supply at time t6, the water level of the flush water in the reservoir tank 4 rises and, accordingly, the float switch 28 is turned on once again at time t7 as the water level of the flush water in the reservoir tank 4 rises to the stopped water level and a full state is created.

Although a case of a large flush has been described with reference to FIG. 3, the time chart shown in FIG. 3 is also applied in a case of a small flush. Note that a large flush and a small flush differ from each other in terms of their spouting times and spouted water amounts as will be described later.

Next, spouting times and spouted water amounts of rim spouting and jet spouting in a large flush and a small flush will be described with reference to FIGS. 4A and 4B. FIG. 4A is a table showing spouting times and spouted water amounts of "early rim spouting", "middle rim spouting", "late rim spouting", and "jet spouting" in a large flush of the flush toilet according to the embodiment of the present invention, and FIG. 4B is a table showing spouting times and spouted water amounts of "early rim spouting", "middle rim spouting", "late rim spouting", and "jet spouting" in a small flush of the flush toilet according to the embodiment of the present invention.

As shown in FIG. 4A, in the case of a large flush, the spouting time of early rim spouting is 1.9 seconds (s) and the spouted water amount of early rim spouting is 0.41 liters (L), the spouting time of middle rim spouting is 2.4 seconds (s) and the spouted water amount of middle rim spouting is 0.52 liters (L), and the spouting time of late rim spouting is 6.1 seconds (s) and the spouted water amount of late rim spouting is 1.32 liters (L). In addition, the spouting time of jet spouting is 2.4 seconds (s) and the spouted water amount of jet spouting is 2.31 liters (L).

As is apparent from FIG. 4A, in the case of a large flush, the spouting time of the early rim spouting (1.9 seconds) is shorter than the spouting time of the late rim spouting (6.1 seconds). Furthermore, a total spouting time of the early rim spouting and the middle rim spouting (1.9 seconds+2.4 seconds) is shorter than the spouting time of the late rim spouting (6.1 seconds).

Similarly, as shown in FIG. 4B, in the case of a small flush, the spouting time of early rim spouting is 1.4 seconds (s) and the spouted water amount of early rim spouting is 0.31 liters (L), the spouting time of middle rim spouting is 1.7 seconds (s) and the spouted water amount of middle rim spouting is 0.37 liters (L), and the spouting time of late rim spouting is 7.6 seconds (s) and the spouted water amount of late rim spouting is 1.64 liters (L). In addition, the spouting time of jet spouting is 1.7 seconds (s) and the spouted water amount of jet spouting is 1.50 liters (L).

As is apparent from FIG. 4B, the case of a small flush is similar to the case of a large flush described above and the spouting time of the early rim spouting (1.4 seconds) is shorter than the spouting time of the late rim spouting (7.6 seconds). Furthermore, the total spouting time of the early rim spouting and the middle rim spouting (1.4 seconds+1.7 seconds) is shorter than the spouting time of the late rim spouting (7.6 seconds).

Figure 5:
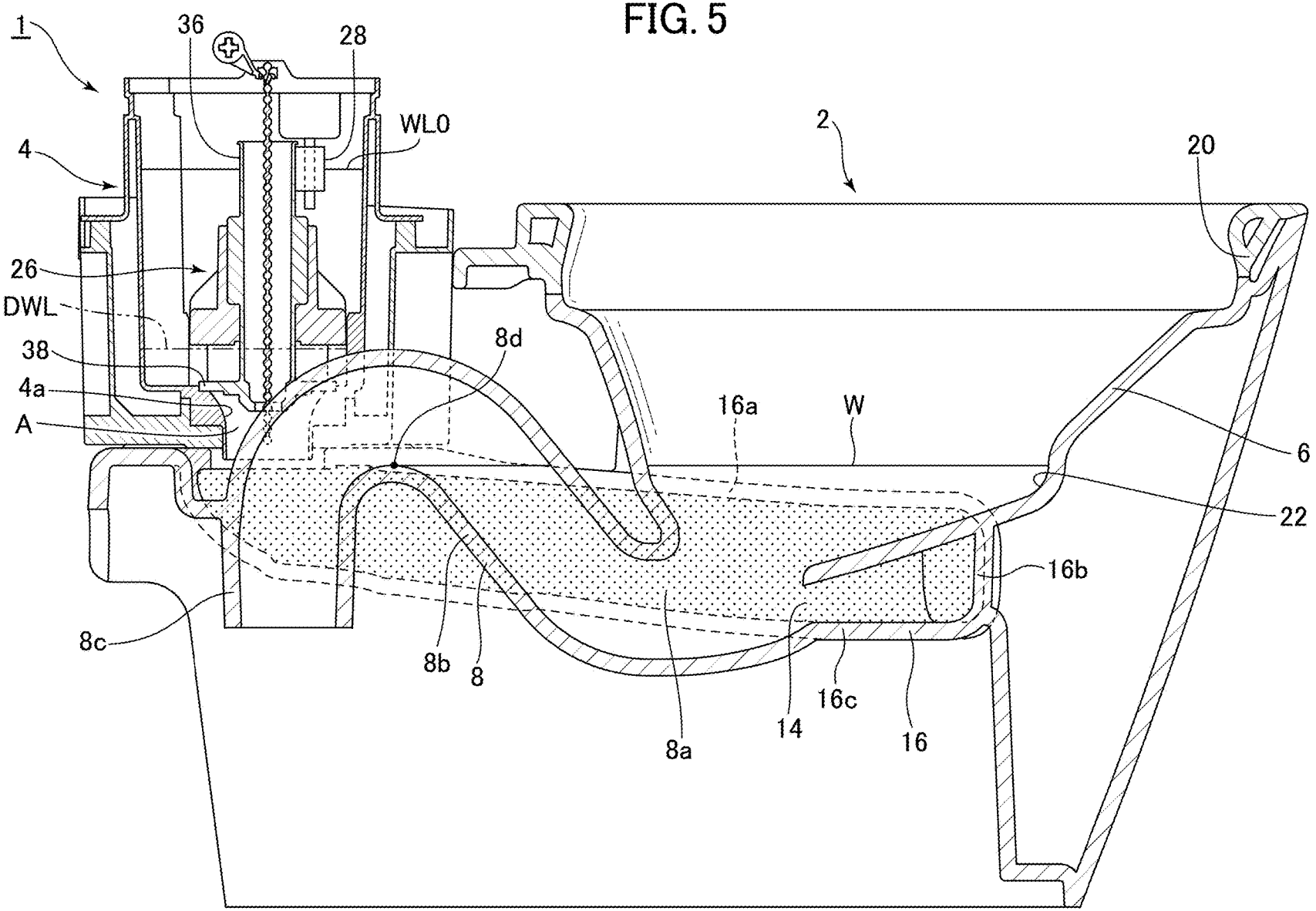
FIG. 5 is a side sectional view of the flush toilet for explaining that air exists between a jet discharge valve and a jet water conduit in the flush toilet according to the embodiment of the present invention.

Next, the existence of air between the jet spouting discharge valve and the jet water conduit in the flush toilet 1 according to the present embodiment will be described with reference to FIG. 5. FIG. 5 is a side sectional view of the flush toilet for explaining that air exists between the jet spouting discharge valve and the jet water conduit in the flush toilet according to the embodiment of the present invention.

As shown in FIG. 5, in the flush toilet 1 in a standby state, the flush water having been spouted by the late rim spouting described above is stored as seal water (pooled water) in a lower part of the bowl 6. Accordingly, the jet water conduit 16 is filled with flush water up to a height position corresponding to the seal water level. On the other hand, since the valve body 38*a* of the jet spouting discharge valve 38 is arranged higher than the seal water level, air A remains between the valve body 38*a* of the jet discharge valve 38 and an upper part of the jet water conduit 16. When the jet spouting discharge valve 38 is opened and the flush water in the reservoir tank 4 flows out to the jet water conduit 16 and is spouted from the jet spout port 14 during jet spouting, a pop noise is created and a pressure loss occurs due to the air A being mixed into the jet spouting.

In the present embodiment, in order to reduce pressure loss created by the air A, the air A that remains between the valve body 38*a* of the jet spouting discharge valve 38 and the upper part of the jet water conduit 16 is exhausted to the outside before the jet spouting discharge valve 38 is opened as in a first example and a second example to be described below.

First, the first example will be described by taking FIG. 3 into consideration. As shown in FIG. 3, after the standby state, at time t1, the rim-side electromagnetic valve 30 opens, flush water is spouted from the rim spout port 10 (in other words, the early rim spouting described above is performed), the flush water is supplied to the bowl 6, the seal water surface (pooled water surface) W rises from the seal water level, and a water surface of the bowl 6 reaches a position higher than the seal water level. At this point, the flush water in the bowl 6 is supplied from the jet spout port 14 into the jet water conduit 16 and, accordingly, the water surface of the jet water conduit 16 rises to a vicinity of the valve body 38*a* of the jet spouting discharge valve 38. In this manner, an amount of flush water which is spouted from the rim spout port 10 is preferably an amount that enables the water surface of the jet water conduit 16 to rise to a vicinity of the valve body 38*a* of the jet spouting discharge valve 38. At this point, since the overflow pipe 36 is arranged so as to extend from lower than the valve body 38*a* of the jet spouting discharge valve 38 to higher than the stopped water level, due to the rise of the water surface of the jet water conduit 16, the air A passes through the inside of the overflow pipe 36 and is exhausted to a space in an upper part of the reservoir tank 4. In this case, the overflow pipe 36 functions as an exhaust pipe.

In the first example, since air is not included in the flush water which flows out to the jet water conduit 16 because, after flush water is spouted from the rim spout port 10 at time t1, the jet spouting discharge valve 38 is opened at time t2 and, even if air is included, an amount of included air is considerably small, pressure loss can be reduced when flush water is spouted from the jet spout port 14.

In the first example described above, the rim-side electromagnetic valve 30 opens, flush water is spouted from the rim spout port 10 and, accordingly, the seal water surface W is raised from the seal water position. The following modification may be adopted in place of the first example. A rim discharge valve (not illustrated) may be provided in the reservoir tank 4 together with the jet spouting discharge valve 38 and the position of the seal water surface W may be raised by opening the rim discharge valve.

Figure 6:
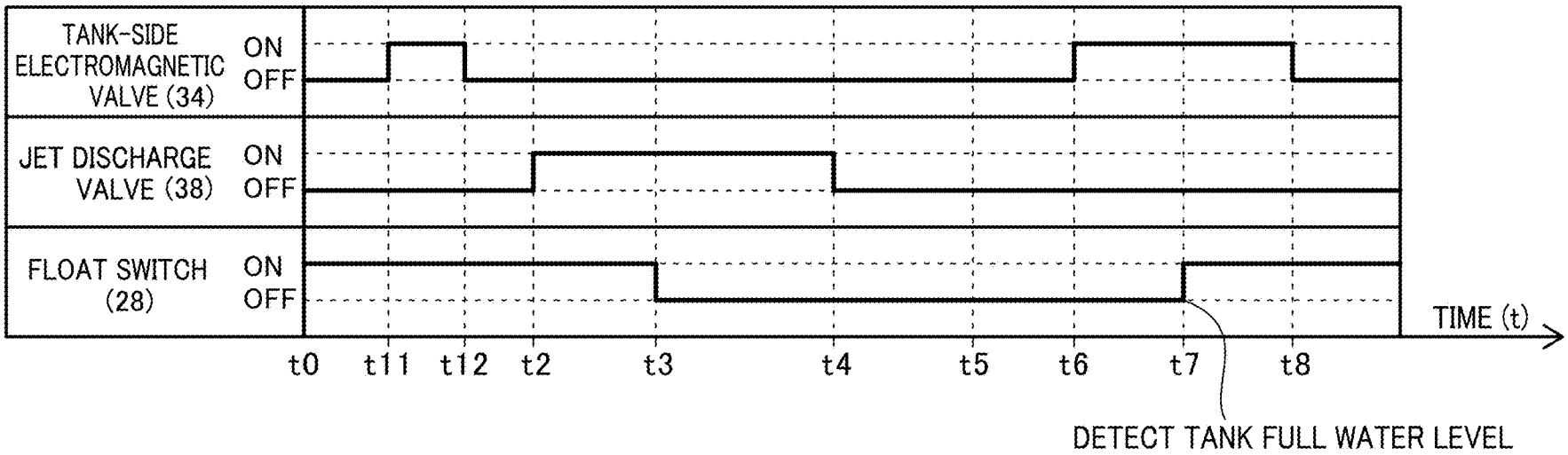
FIG. 6 is a time chart showing another example for removing air that exists between the jet discharge valve and the jet water conduit.

Next, the second example will be described with reference to FIG. 6. FIG. 6 is a time chart showing another example (second example) for removing air that exists between the jet discharge valve and the jet water conduit.

As shown in FIG. 6, after a standby state, from time t11 to time t12, the tank-side electromagnetic valve 34 is opened and flush water is supplied to the reservoir tank 4. At this point, since the water level of the reservoir tank 4 is the stopped water level, when supplying water causes the water level of the reservoir tank 4 to rise from the stopped water level to an upper end of the overflow pipe 36, flush water flows into the overflow pipe 36 from an opening of the upper end of the overflow pipe 36 and is supplied to the jet water conduit 16. Accordingly, the water surface of the jet water conduit 16 rises to a vicinity of the valve body 38*a* of the jet spouting discharge valve 38. Accordingly, the air A passes through the inside of the overflow pipe (exhaust pipe) 36 and is exhausted to a space in an upper part of the reservoir tank 4.

In the second example, since air is not included in the flush water which flows out to the jet water conduit 16 because, after supplying of flush water into the reservoir tank 4 ends at time t12, the jet spouting discharge valve 38 is opened at time t2 and, even if air is included, an amount of included air is considerably small, pressure loss can be reduced when flush water is spouted from the jet spout port 14.

Figure 7:
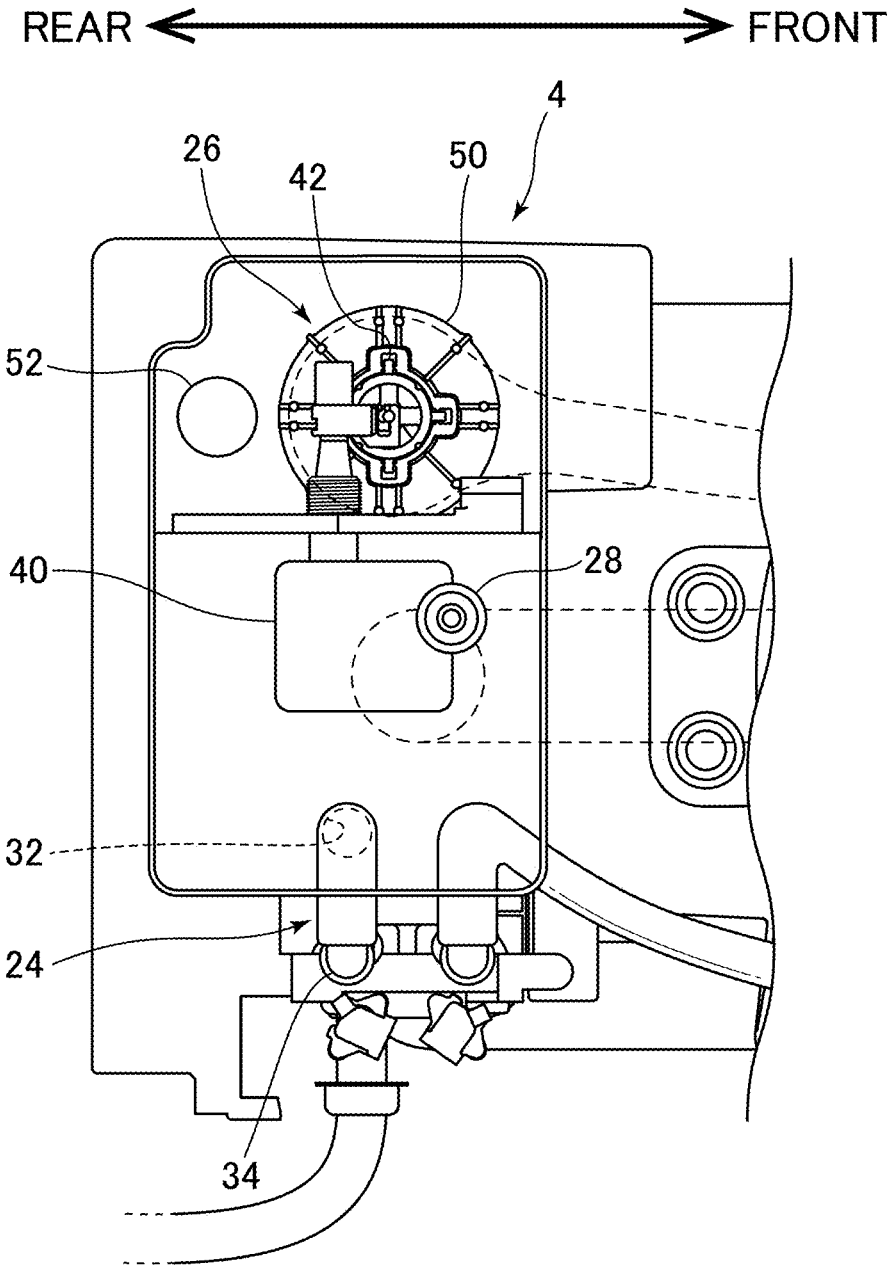
FIG. 7 is a partial plan view showing another example of an arrangement of the jet discharge valve and an overflow pipe (exhaust pipe) of the flush toilet according to the embodiment of the present invention.

Next, another example of an arrangement of the jet discharge valve and the overflow pipe will be described with reference to FIG. 7. FIG. 7 is a partial plan view showing another example of an arrangement of the jet discharge valve and the overflow pipe (exhaust pipe) of the flush toilet according to the embodiment of the present invention.

As shown in FIG. 7, in this example, a jet spouting discharge valve 50 does not include an overflow pipe and simply opens and closes a discharge port of the reservoir tank 4. Furthermore, an overflow pipe 52 is arranged on the rear side of the jet discharge valve 50.

Figure 8:
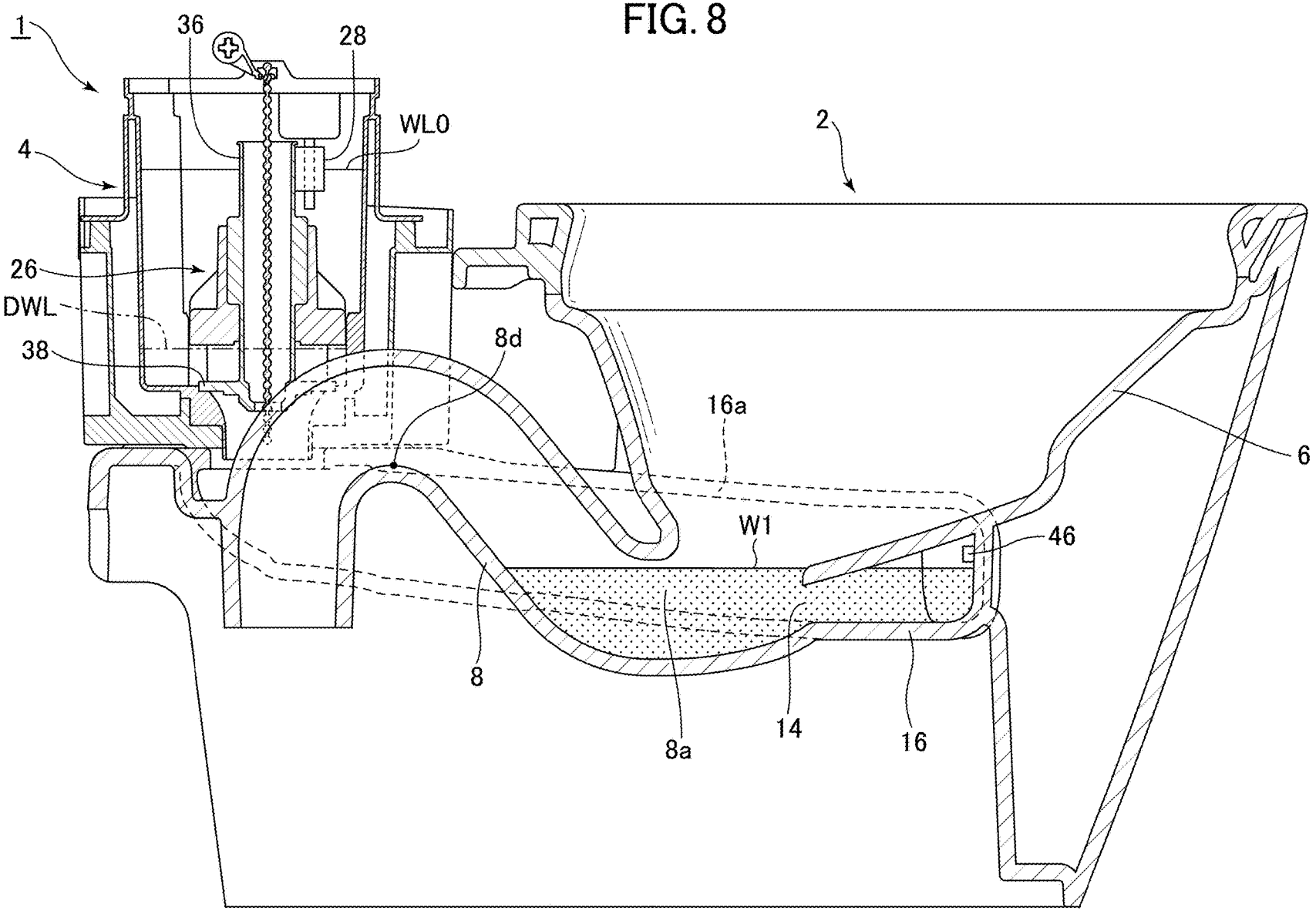
FIG. 8 is a side sectional view of the flush toilet showing a state where a seal water position is lower than a predetermined seal water level in the flush toilet.

Next, a case where the seal water position becomes lower than a predetermined seal water level in the flush toilet will be described with reference to FIG. 8. FIG. 8 is a side sectional view of the flush toilet showing a state where the seal water position is lower than a predetermined seal water level in the flush toilet.

In the flush toilet 1, the seal water level is set based on the inlet 8*a* of the discharge trap conduit 8 and is normally held at a predetermined seal water level (a position of the seal water surface W in FIG. 2).

While the seal water position is normally held at the predetermined seal water level (a position of the seal water surface W) in the flush toilet 1, a seal water position W1 may become lower than the seal water level as shown in FIG. 8 in situations such as that described below.

For example, when installing the toilet or turning on power of the toilet, flush water may not be supplied to the bowl and, in such a case, the seal water position is low. In addition, the seal water position also drops when waste is clogged in a water distributing pipe or a discharge trap conduit and drainage of flush water due to a siphon action is prolonged. Furthermore, the seal water position may be low when power is turned on after removing clogging due to waste. The seal water position also drops when, simply, an amount of flush water which the bowl is supplied (refilled) with is small.

As described above, the present inventors have found that, when flush water is spouted from the jet spout port 14 in a state where the seal water position is lower than a predetermined seal water level, air trapped in the jet water conduit 16 is ejected from the jet spout port 14 and water splashing occurs in which the air pushes out flush water.

Based on the finding, the present inventors performed an experiment to examine what kind of seal water positions caused water splashing to occur frequently.

Figure 9:
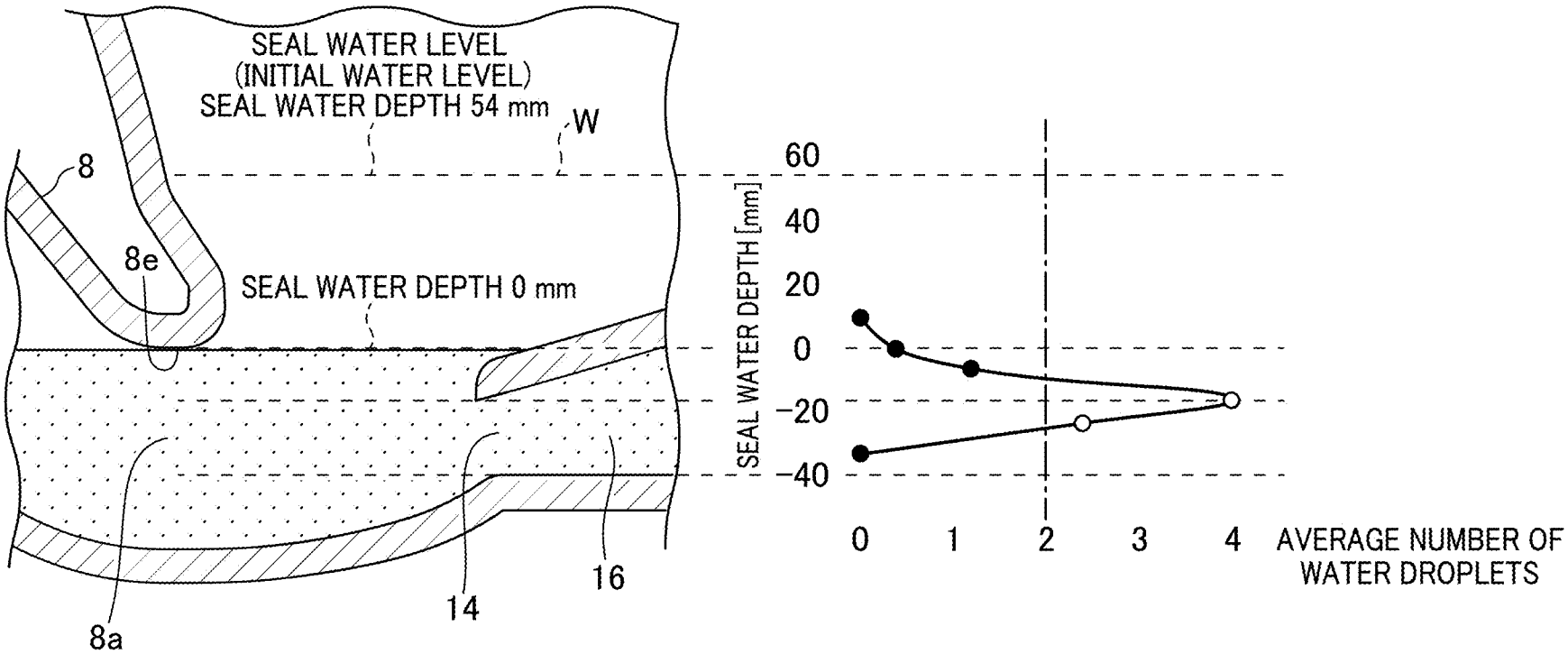
FIG. 9 is a diagram obtained by an experiment showing a relationship between the seal water position (seal water depth) and an average number of water droplets (water splashing) in a case where the seal water position is lower than the predetermined seal water level.

FIG. 9 is a diagram obtained by an experiment showing a relationship between the seal water position (seal water depth) and an average number of water droplets (water splashing) in a case where the seal water position is lower than the predetermined seal water level. In FIG. 9, the seal water position (seal water depth) is based on an upper end portion 8*e* of the inlet 8*a* of the discharge trap conduit 8. As is apparent from FIG. 9, it was found that splashing of water droplets occurred at a highest frequency when the seal water position (seal water depth) is in a vicinity of the upper end of the jet spout port 14.

Next, a method of detecting that the seal water position has become lower than a predetermined seal water level will be described. First, a water level sensor 46 for detecting the seal water position is provided at one location or a plurality of locations inside the jet water conduit 16 (refer to FIG. 8) and a drop of the seal water position to below the predetermined seal water level is detected by the water level sensor 46.

Next, as described above, the reservoir tank 4 is provided with the float switch 28 for detecting the stopped water level (WL0). Due to the float switch 28, a drop of the seal water position can be indirectly detected from a change in water supply time to the reservoir tank 4.

Specifically, when the seal water position is the predetermined seal water level, the water level in the reservoir tank 4 after performing jet spouting has dropped to the predetermined dead water level (DWL). However, for example, when waste is clogged in a water distributing pipe or the discharge trap conduit 8 and the seal water position is lower than the predetermined seal water level, since head pressure between the water level of the flush water in the reservoir tank and the seal water position increases and a large amount of flush water is drained from the reservoir tank during a flush, the water level becomes lower than the predetermined dead water level (DWL). When water supply into the reservoir tank 4 is started from this state, a time from the dead water level (DWL) to the stopped water level (WL0) detected by the float switch 28 becomes longer and a deviation from a normal water supply time is created. A drop in the seal water position can be detected based on the deviation of the water supply time (the water supply time increases).

A float switch for detecting the dead water level (DWL) may be provided, the float switch may detect that the dead water level is lower than a predetermined dead water level and, accordingly, a drop in the seal water position may be detected.

In addition, as another example of detecting a drop in the seal water position, when a change in an inflow amount from a water source is predicted based on the time required by the water level of the reservoir tank 4 to rise from the dead water level (DWL) to the stopped water level (WL0) and a longer time than normal is required by the water level to rise, there is a possibility that the inflow amount from the water source has dropped. In such a case, since a refill by the late rim spouting to be described later is insufficient and the seal water position drops, a drop of the seal water position can be detected based on the time required by the water level in the reservoir tank to rise.

In the flush toilet 1 according to the present embodiment, when the seal water position being lower than the predetermined seal water level is detected in this manner, flush water is replenished to the bowl 6 before performing jet spouting and jet spouting is performed in a state where the seal water position has been restored to the predetermined seal water position. The replenishing of flush water to the bowl 6 is executed according to the first example and the second example described below.

In the first example, a time from time t1 to time t2 which is a time for early rim spouting shown in FIG. 3 is made longer than normal (when the seal water position is at a predetermined seal water level) (time t1 is hastened) and, due to the longer time, a supply amount of flush water to the bowl 6 is increased than normal to restore the dropped seal water position to the predetermined seal water level. Subsequently, jet spouting is started at time t2.

In the second example, before the jet spouting shown in FIG. 3 is started at time t2, the tank-side electromagnetic valve 34 is opened to supply flush water to the reservoir tank 4 and the water level in the reservoir tank 4 is raised higher than the upper end of the overflow pipe 36. Accordingly, the flush water flows into the overflow pipe 36 from the upper end thereof and passes through the jet water conduit 16, the flush water is replenished to the inside of the bowl 6, and the seal water position is restored to the predetermined seal water level. Subsequently, jet spouting is started.

Next, a flush operation of the flush toilet according to the embodiment of the present invention will be described with reference to FIGS. 10A to 10F FIGS. 10A to 10F are views for explaining the flush operation of the flush toilet according to the embodiment of the present invention.

Figure 10A:
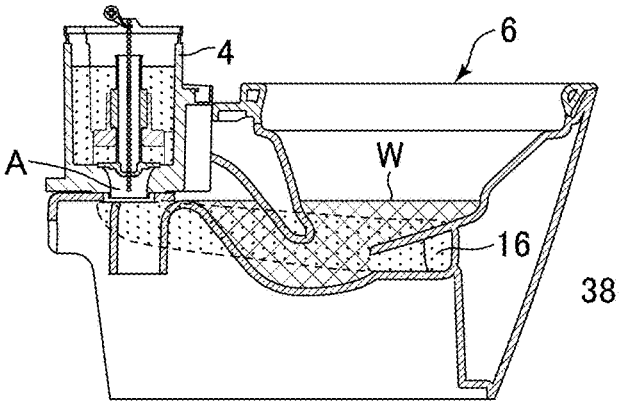
FIG. 10A is a view for explaining a flush operation of the flush toilet according to the embodiment of the present invention.

FIG. 10A shows a standby state where flush water is stored up to the seal water level W in the bowl 6 and flush water is also stored up to a same height position as the seal water level in the jet water conduit 16. At this point, as described above, the air A is retained between the valve body 38*a* of the jet spouting discharge valve 38 of the reservoir tank 4 and an upper part of the jet water conduit 16.

Figure 10B:
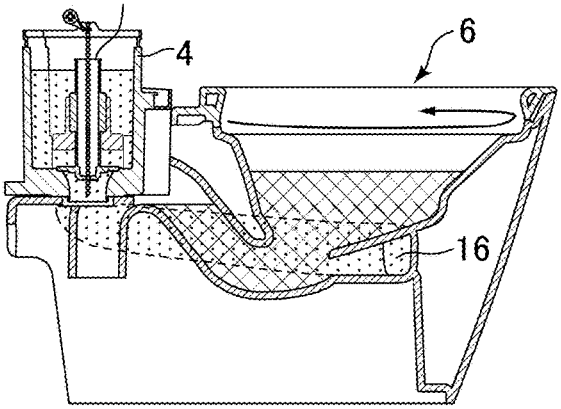
FIG. 10B is a view for explaining the flush operation of the flush toilet according to the embodiment of the present invention.

Next, as shown in FIG. 10B, the rim-side electromagnetic valve 30 opens, rim spouting is started, and the water level of the flush water gradually rises in the bowl 6. Accordingly, the water level of the flush water also gradually rises in the jet water conduit 16, the retained air A is exhausted from the overflow pipe 36, and the jet water conduit 16 becomes filled with water (refer to the first example described above).

Figure 10C:
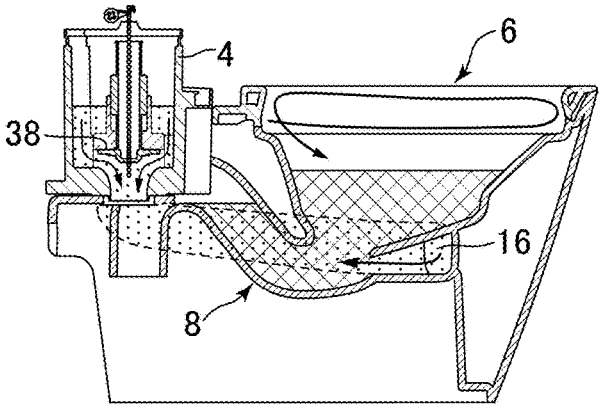
FIG. 10C is a view for explaining the flush operation of the flush toilet according to the embodiment of the present invention.

Subsequently, as shown in FIG. 10C, the jet spouting discharge valve 38 opens while rim spouting is in progress and jet spouting is started. At this point, since pooled water (seal water) remaining in the bowl 6 and flush water due to the rim spouting join flush water due to the jet spouting and flush water with a large flow rate flows into the discharge trap conduit 8, a strong siphon action is created and waste is discharged.

Figure 10D:
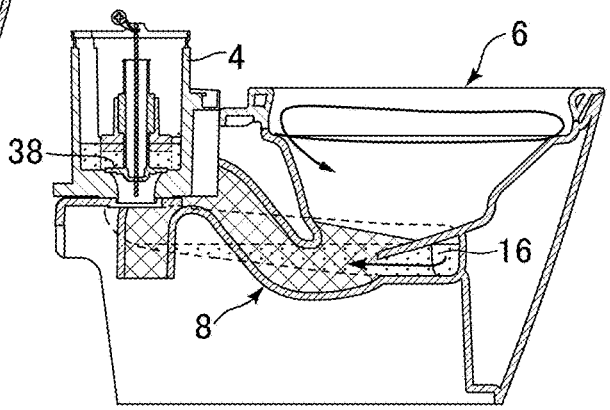
FIG. 10D is a view for explaining the flush operation of the flush toilet according to the embodiment of the present invention.

Next, as shown in FIG. 10D, the jet spouting discharge valve 38 closes while rim spouting is in progress. Even when the jet spouting discharge valve 38 closes, since the rim spouting and the jet spouting flow into the discharge trap conduit 8, the siphon action can be continued.

Figure 10E:
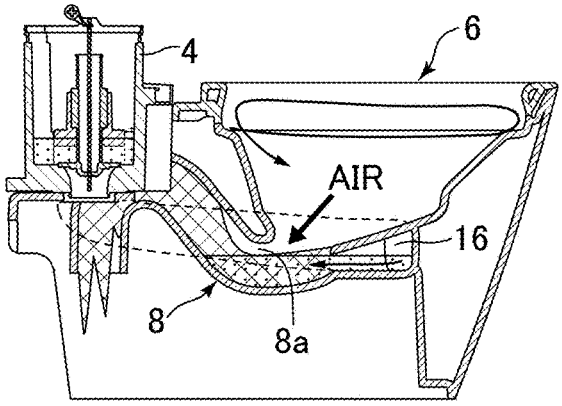
FIG. 10E is a view for explaining the flush operation of the flush toilet according to the embodiment of the present invention.

Subsequently, as shown in FIG. 10E, the water level of the flush water in the bowl 6 drops due to pooled water being drained by the siphon action, air penetrates from an upper part of the inlet 8*a* of the discharge trap conduit 8, and the siphon action ends. The rim spouting is continuously performed even after the siphon action ends and the rim spouting ends once the flush water is stored up to the seal water level in the bowl 6. At this point, flush water is also stored up to a same height position as the seal water level in the jet water conduit 16.

Figure 10F:
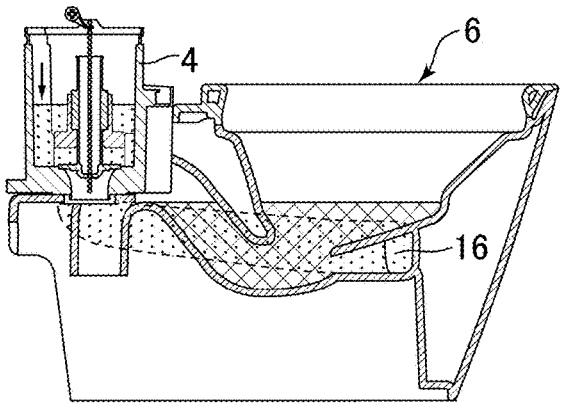
FIG. 10F is a view for explaining the flush operation of the flush toilet according to the embodiment of the present invention.

Next, as shown in FIG. 10F, the tank-side electromagnetic valve 34 opens and tank water supply is started. Once the water level of the flush water in the reservoir tank 4 rises and the float switch 28 detects a state of a stopped water level, the tank-side electromagnetic valve 34 closes and, subsequently, the original standby state is restored as shown in FIG. 10A.

Figure 11A:
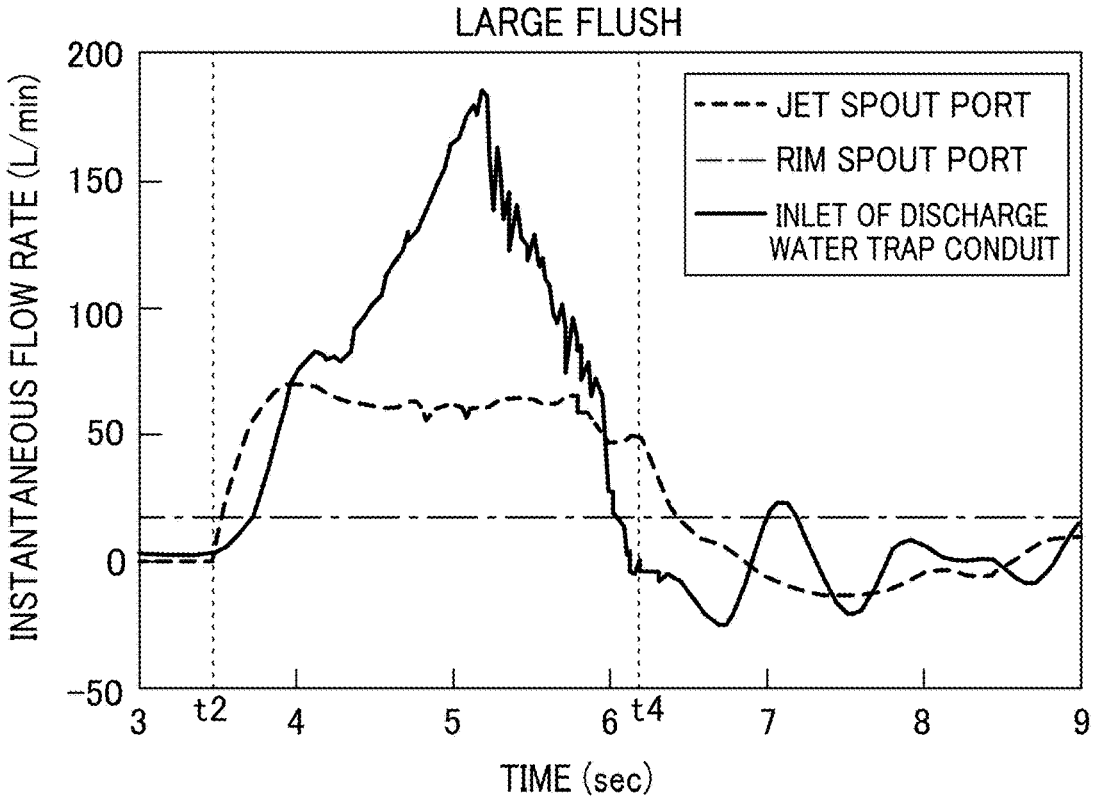
FIG. 11A is a diagram showing an instantaneous flow rate of flush water which is spouted from a rim spout port, an instantaneous flow rate of flush water which is spouted from a jet spout port, and an instantaneous flow rate of flush water which flows into an inlet of a discharge trap conduit during a large flush of the flush toilet according to the embodiment of the present invention.

Next, an instantaneous flow rate of flush water which is spouted from the rim spout port, an instantaneous flow rate of flush water which is spouted from the jet spout port, and an instantaneous flow rate of flush water which flows into the inlet of the discharge trap conduit during a large flush and a small flush of the flush toilet according to the embodiment of the present invention will be described with reference to FIG. 11A and FIG. 11B. FIG. 11A is a diagram showing an instantaneous flow rate of flush water which is spouted from the rim spout port, an instantaneous flow rate of flush water which is spouted from the jet spout port, and an instantaneous flow rate of flush water which flows into the inlet of the discharge trap conduit during a large flush of the flush toilet according to the embodiment of the present invention, and FIG. 11B is a diagram showing an instantaneous flow rate of flush water which is spouted from the rim spout port, an instantaneous flow rate of flush water which is spouted from the jet spout port, and an instantaneous flow rate of flush water which flows into the inlet of the discharge trap conduit during a small flush of the flush toilet according to the embodiment of the present invention.

Figure 11B:
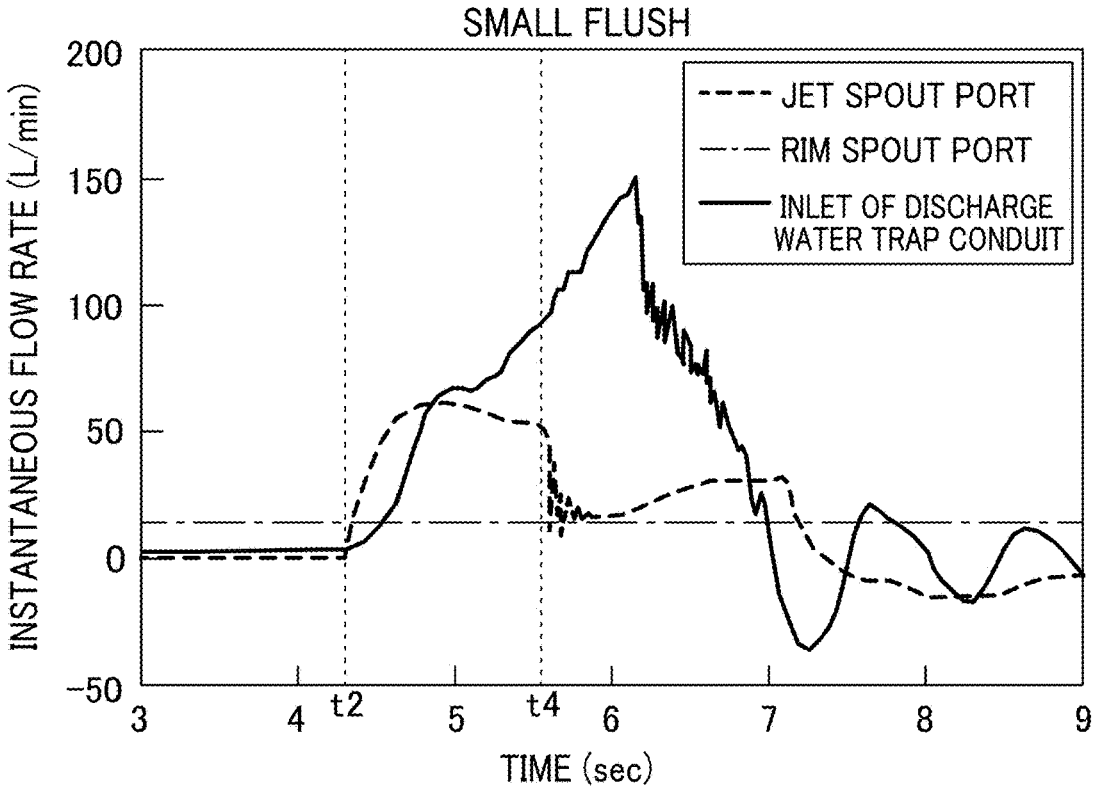
FIG. 11B is a diagram showing an instantaneous flow rate of flush water which is spouted from a rim spout port, an instantaneous flow rate of flush water which is spouted from a jet spout port, and an instantaneous flow rate of flush water which flows into an inlet of a discharge trap conduit during a small flush of the flush toilet according to the embodiment of the present invention.

In FIGS. 11A and 11B, dashed lines represent an instantaneous flow rate of flush water which is spouted from the jet spout port 14, dashed-dotted lines represent an instantaneous flow rate of flush water which is spouted from the rim spout port 10, and solid lines represent an instantaneous flow rate of flush water which flows into the inlet 8*a* of the discharge trap conduit 8.

As shown in FIG. 11A, in a large flush, at time t2, the jet discharge valve 38 is opened and the flush water in the reservoir tank 4 passes through the jet water conduit 16 and is spouted from the jet spout port 14. The instantaneous flow rate of jet spouting represented by the dashed line suddenly increases immediately after start and subsequently becomes approximately constant. At time t4, the jet discharge valve 38 is closed and, accordingly, the instantaneous flow rate of the jet spouting also starts to decrease.

The instantaneous flow rate of the rim spouting represented by the dashed-dotted line is constant and the rim spouting is performed even from time t2 to time t4 during which the jet spouting is performed.

Furthermore, flush water having been spouted by the late rim spouting during the previous flush remains as pooled water in the bowl 6.

Therefore, from time t2 to time t4, the flush water due to the rim spouting and the pooled water remaining in the bowl 6 due to the late rim spouting during the previous flush join the flush water due to the jet spouting and flush water with a large flow rate flows into the inlet 8*a* of the discharge trap conduit 8 as represented by the solid line.

As a result, according to the present invention, even when flush water is supplied to the jet water conduit 16 due to the head pressure of the flush water in a low silhouette reservoir tank (although a siphon action can hardly be generated by the jet spouting alone), since the flush water due to the rim spouting and the pooled water flow into the inlet 8*a* of the discharge trap conduit 8 together with the flush water due to the jet spouting, waste can be reliably discharged by a strong siphon action.

After the jet spouting discharge valve 38 closes at time t4, while the instantaneous flow rate of the jet spouting decreases, the rim spouting is continued at the same instantaneous flow rate. Therefore, while the instantaneous flow rate of flush water due to the jet spouting and the rim spouting decreases, accordingly, the siphon action can be continued.

In this manner, since a strong siphon action can be generated and the siphon action can be continued without increasing an amount of water stored in the reservoir tank 4, water conservation can be achieved.

Next, as shown in FIG. 11B, in a small flush, at time t2, the jet spouting discharge valve 38 is opened and the flush water in the reservoir tank 4 passes through the jet water conduit 16 and is spouted from the jet spout port 14. The instantaneous flow rate of jet spouting represented by the dashed line suddenly increases immediately after start and subsequently becomes approximately constant. At time t4, the jet discharge valve 38 is closed and, accordingly, the instantaneous flow rate of the jet spouting also starts to decrease.

The instantaneous flow rate of the rim spouting represented by the dashed-dotted line is constant and the rim spouting is performed even from time t2 to time t4 during which the jet spouting is performed.

Furthermore, flush water having been spouted by the late rim spouting during the previous flush remains as pooled water in the bowl 6.

Therefore, from time t2 to time t4, the flush water due to the jet spouting and the rim spouting flows into the inlet 8*a* of the discharge trap conduit 8. However, after time t4, the flush water due to the rim spouting and the pooled water remaining in the bowl 6 join the flush water due to the jet spouting and flush water with a large flow rate flows into the inlet 8*a* of the discharge trap conduit 8 as represented by the solid line.

As a result, according to the present invention, similarly, in the case of a small flush, even when flush water is supplied to the jet water conduit 16 due to the head pressure of the flush water in a low silhouette reservoir tank (although a siphon action can hardly be generated by the jet spouting alone), since the flush water due to the rim spouting and the pooled water flow into the inlet 8*a* of the discharge trap conduit 8 together with the flush water due to the jet spouting, waste can be reliably discharged by a strong siphon action.

Furthermore, while the instantaneous flow rate of flush water due to the jet spouting and the rim spouting decreases after the strong siphon action is generated, accordingly, the siphon action can be continued.

In this manner, similarly, in the case of a small flush, since a strong siphon action can be generated and the siphon action can be continued without increasing an amount of water stored in the reservoir tank 4, water conservation can be achieved.

Figure 12A:
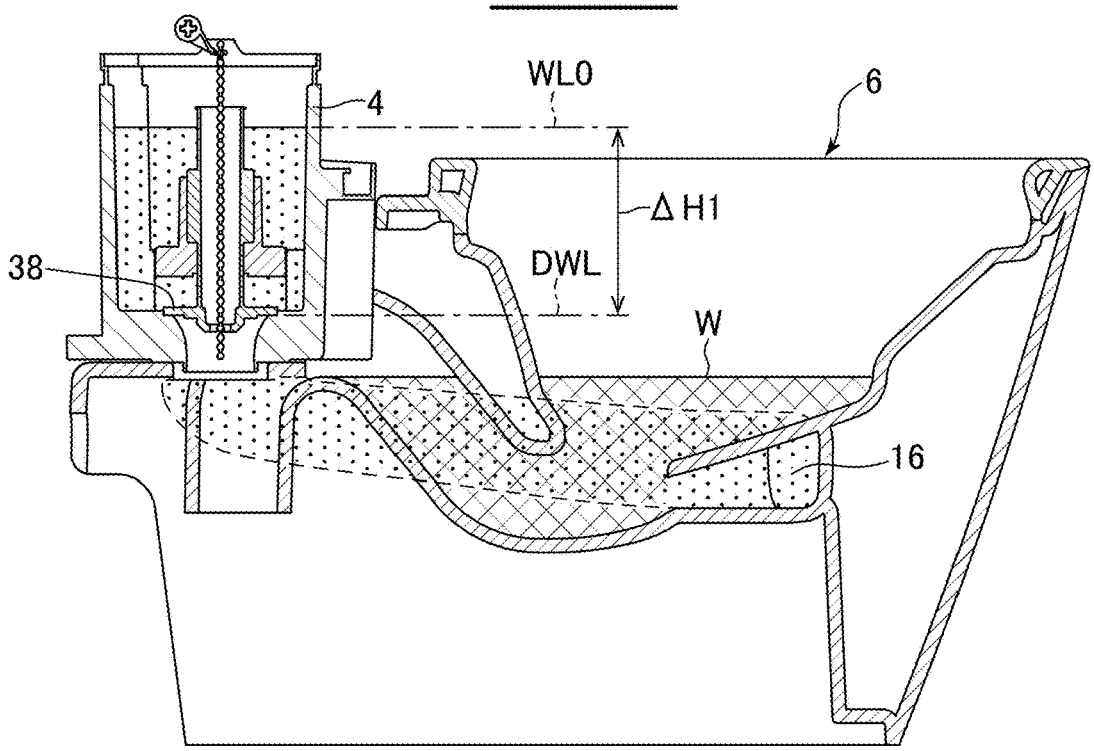
FIG. 12A is a side sectional view showing a water level difference ΔH1 between a stopped water level WL0 and a dead water level DWL of flush water in a reservoir tank during standby in the flush toilet according to the embodiment of the present invention.

Next, a water level difference between a water level of flush water of the reservoir tank and a pooled water surface in a normal state (when there is no toilet clogging) of the flush toilet 1 according to the present embodiment will be described with reference to FIGS. 12A to 12C. FIG. 12A is a side sectional view showing a water level difference ΔH1 between a stopped water level WL0 and a dead water level DWL of the flush water in the reservoir tank during standby in the flush toilet according to the embodiment of the present invention, FIG. 12B is a side sectional view showing a water level difference ΔH2 between the dead water level DWL of the flush water in the reservoir tank and a pooled water surface W upon reaching DWL, and FIG. 12C is a side sectional view showing a water level difference ΔH3 between the stopped water level WL0 and the dead water level DWL of the flush water in the reservoir tank when supplying water to the tank.

First, as shown in FIG. 12A, during standby, there is a water level difference of ΔH1 between the stopped water level WL0 and the dead water level DWL of the reservoir tank 4 and the dead water level DWL is at a higher position than the water level of the pooled water surface W. Therefore, even when an opening operation of the jet discharge valve 38 is performed after standby, the pooled water of the pooled water surface W does not flow backward to the reservoir tank 4.

Figure 12B:
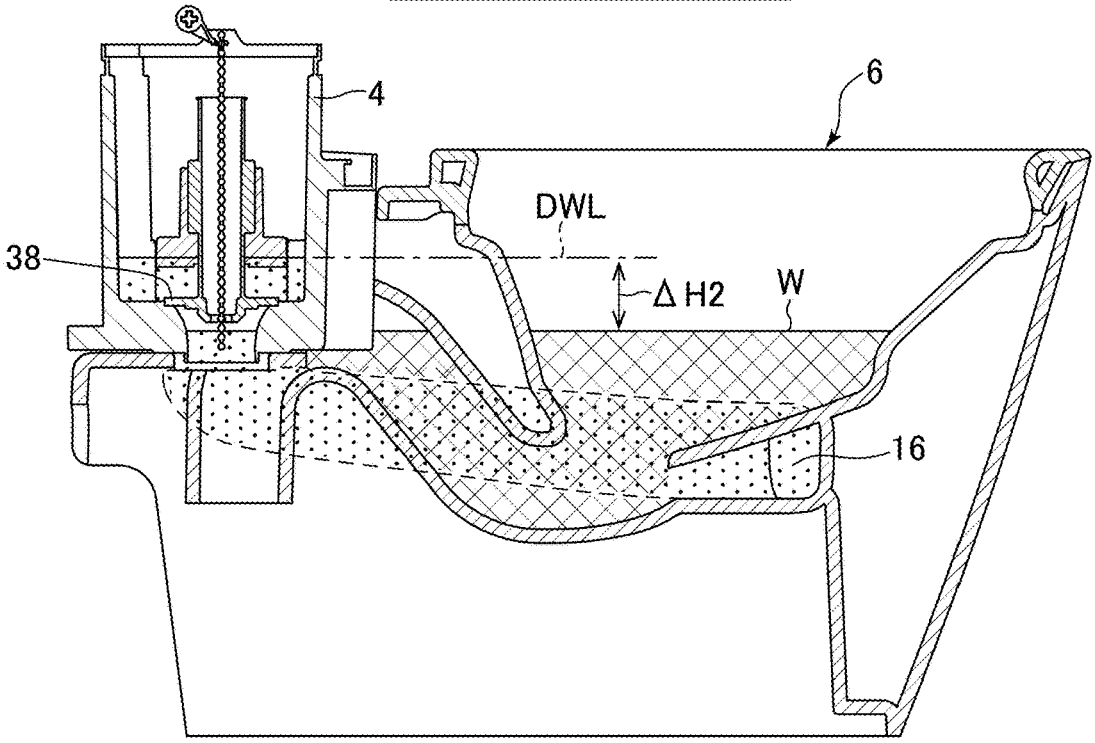
FIG. 12B is a side sectional view showing a water level difference ΔH2 between the dead water level DWL of flush water in the reservoir tank and a pooled water surface W upon reaching DWL in the flush toilet according to the embodiment of the present invention.

Next, as shown in FIG. 12B, upon reaching DWL, the pooled water surface W has risen as compared to during standby described above. However, there is a water level difference of ΔH2 (<ΔH1) between the dead water level DWL of the reservoir tank 4 and the pooled water surface W. Therefore, even in a state where the jet discharge valve 38 is opened and the reservoir tank 4 and the pooled water surface W are communicated with each other before and after reaching DWL, since a sufficient water level difference exists between the dead water level DWL and the pooled water surface W as shown in FIG. 12B, the pooled water of the pooled water surface W does not flow backward to the reservoir tank 4.

Figure 12C:
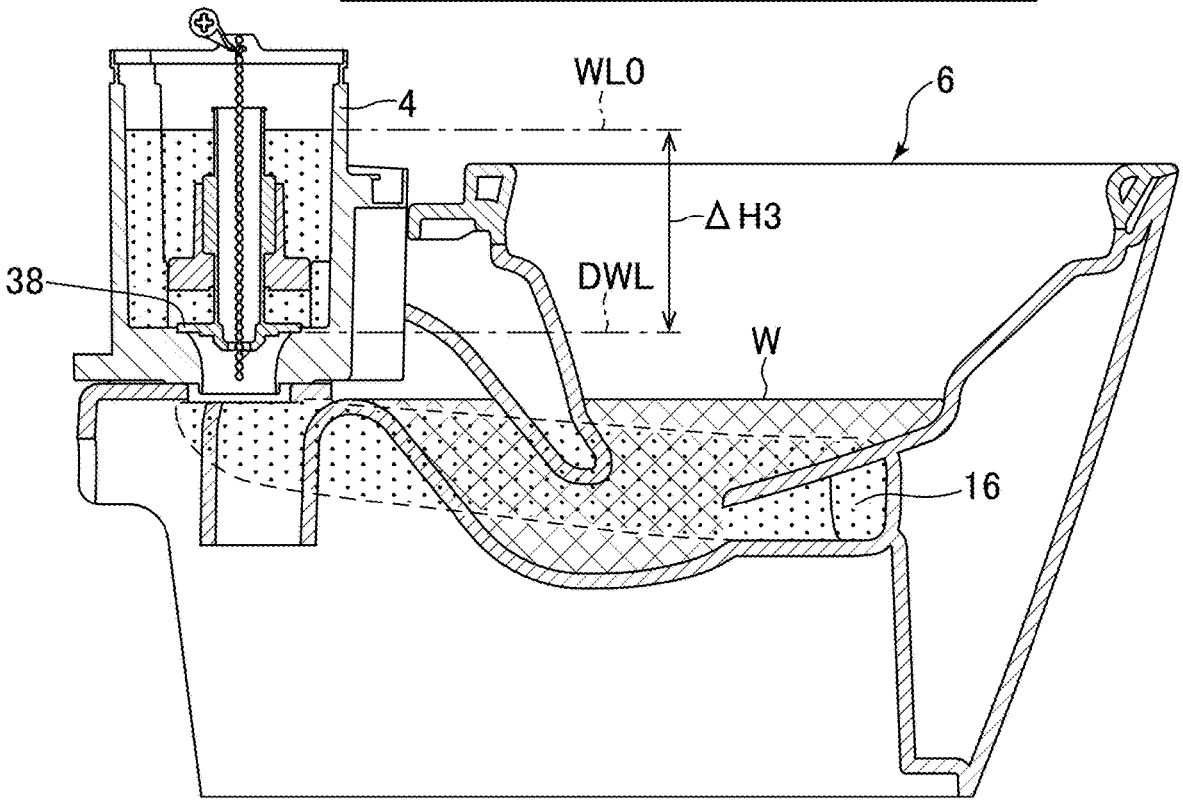
FIG. 12C is a side sectional view showing a water level difference ΔH3 between the stopped water level WL0 and the dead water level DWL of flush water in the reservoir tank when supplying water to the tank in the flush toilet according to the embodiment of the present invention.

Next, as shown in FIG. 12C, when supplying water to the tank, there is a water level difference of ΔH3 (=ΔH1) between the stopped water level WL0 and the dead water level DWL of the reservoir tank 4 and the dead water level DWL is at a higher position than the water level of the pooled water surface W in the same manner as during standby described above. Therefore, even when an opening operation of the jet spouting discharge valve 38 is performed in this state and the pooled water surface W and the reservoir tank are communicated with each other, the pooled water of the pooled water surface W does not flow backward to the reservoir tank 4.

Figure 13A:
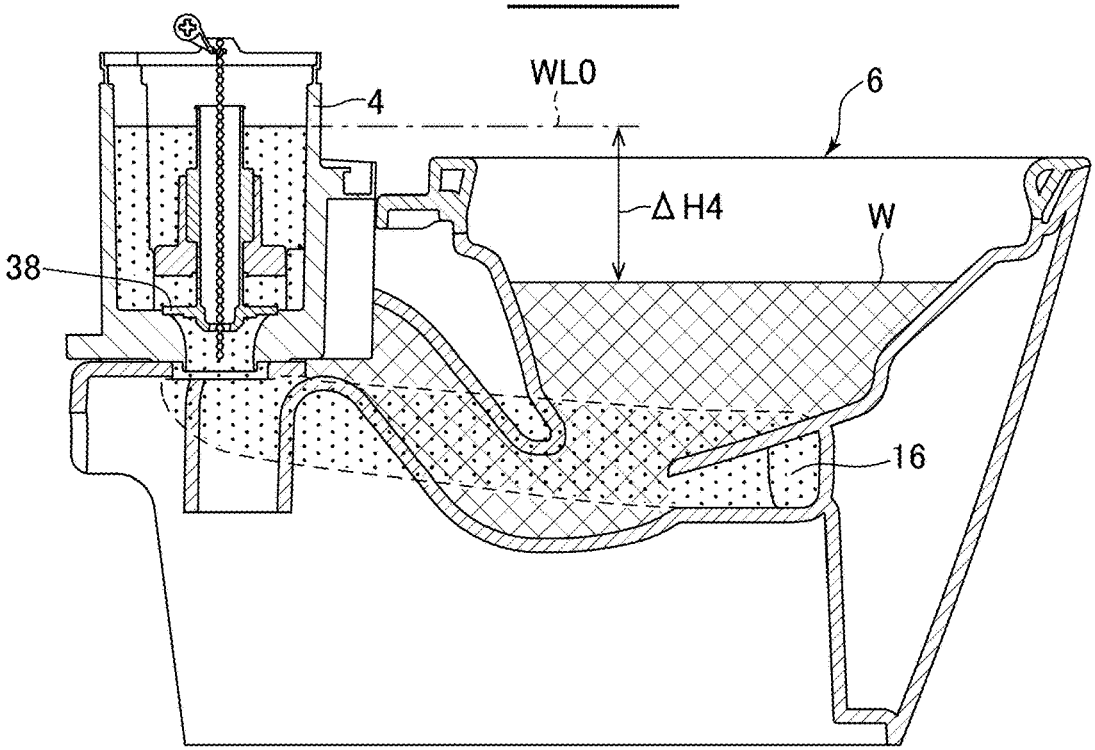
FIG. 13A is a side sectional view showing a water level difference ΔH4 between the stopped water level WL0 of flush water in the reservoir tank and the pooled water surface W during standby in a toilet-clogged state of the flush toilet according to the embodiment of the present invention.

Next, a head between a water level of flush water of the reservoir tank and a pooled water surface in a toilet-clogged state of the flush toilet 1 according to the present embodiment will be described with reference to FIGS. 13A to 13C. FIG. 13A is a side sectional view showing a water level difference ΔH4 between the stopped water level WL0 of the flush water in the reservoir tank and the pooled water surface W during standby in a toilet-clogged state of the flush toilet according to the embodiment of the present invention, FIG. 13B is a side sectional view showing a water level difference ΔH5 between the dead water level DWL of the flush water in the reservoir tank and the pooled water surface W upon reaching DWL, and FIG. 13C is a side sectional view showing a water level difference ΔH6 between the stopped water level WL0 of the flush water in the reservoir tank and the pooled water surface W when supplying water to the tank.

First, a method of detecting that the pooled water surface W has risen from a normal position (seal water position) will be described. In a toilet-clogged state, when the pooled water surface W has risen from a normal position, since head pressure between the water level of the flush water of the reservoir tank 4 and the pooled water surface decreases and an amount of flush water that is drained from the reservoir tank 4 during a flush is smaller than normal, the water level in the reservoir tank 4 is at a higher position than a normal position of the dead water level (DWL). When water supply into the reservoir tank 4 is started from this state, a time from the dead water level at the higher position described above to the stopped water level (WL0) to be detected by the float switch 28 becomes shorter and a deviation from a normal water supply time occurs. A rise of the pooled water surface W can be detected based on the deviation of the water supply time (the water supply time decreases).

First, as shown in FIG. 13A, in a toilet-clogged state, the pooled water surface W has risen from a normal position during standby. Therefore, the water level difference between the stopped water level WL0 of the reservoir tank 4 and the pooled water surface W is ΔH4 which is a smaller water level difference than in a normal state. However, since the stopped water level WL0 is higher than the upper surface of the bowl, even when an opening operation of the jet discharge valve 38 is performed in this state, the pooled water of the pooled water surface W does not flow backward to the reservoir tank 4.

Figure 13B:
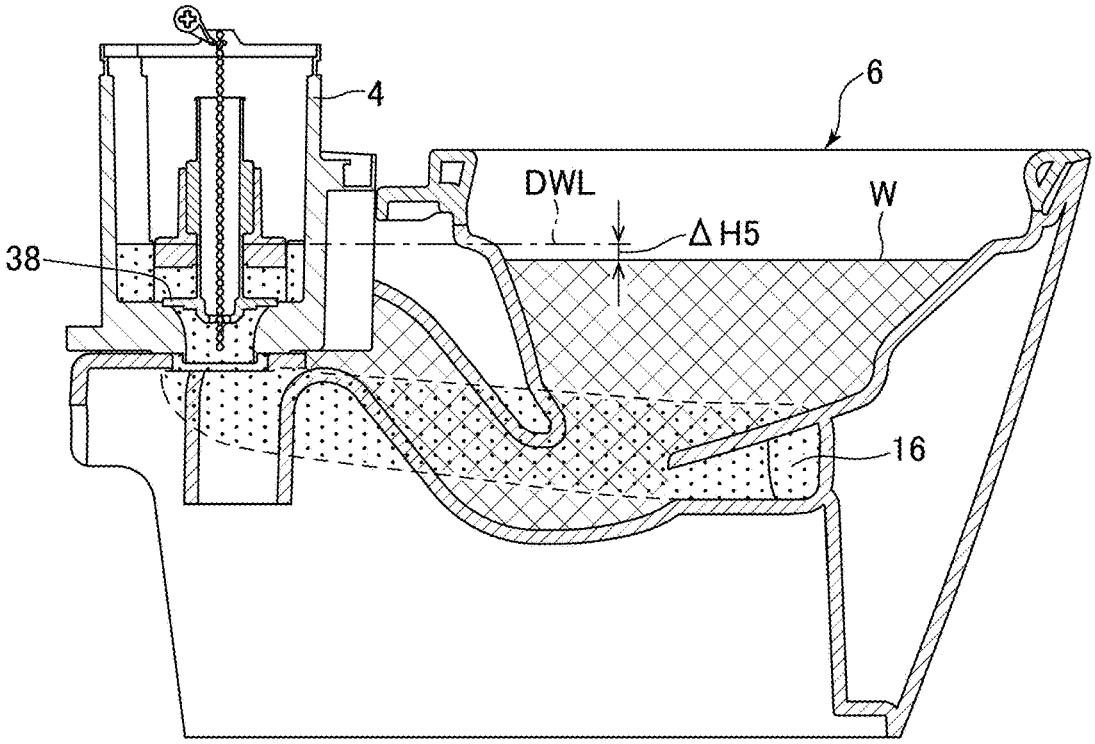
FIG. 13B is a side sectional view showing a water level difference ΔH5 between the dead water level DWL of flush water in the reservoir tank and the pooled water surface W upon reaching DWL in a toilet-clogged state of the flush toilet according to the embodiment of the present invention.
Figure 13C:
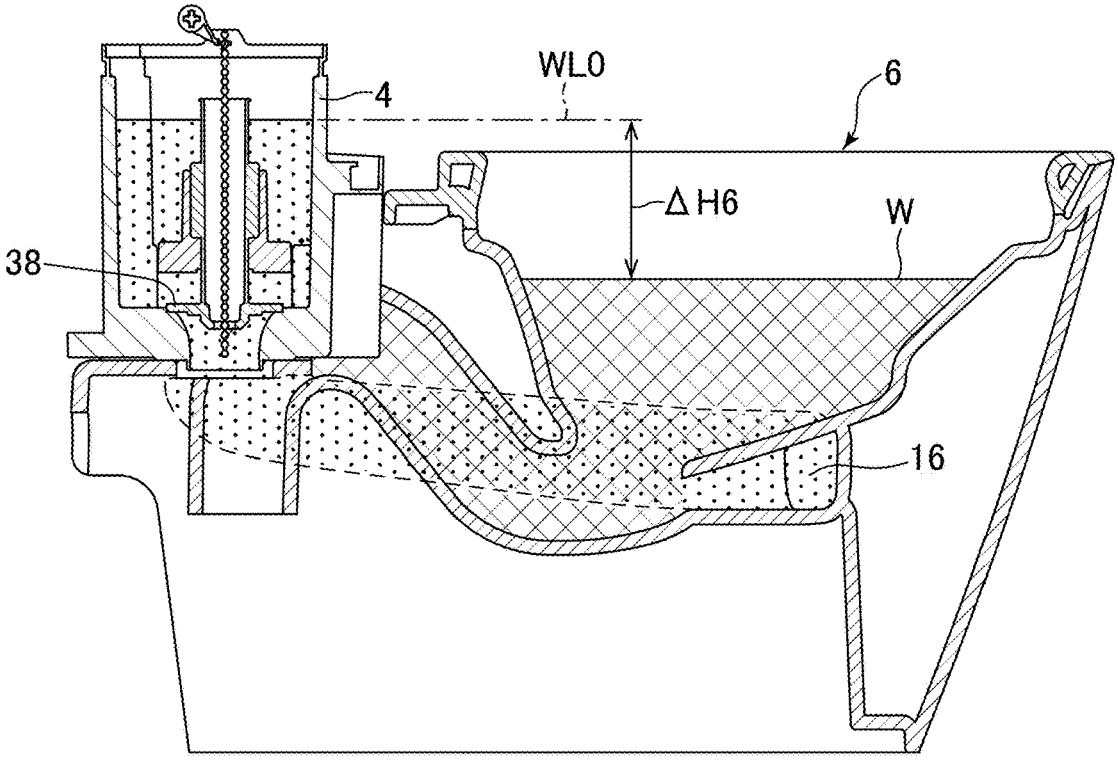
FIG. 13C is a side sectional view showing a water level difference ΔH6 between the stopped water level WL0 of flush water in the reservoir tank and the pooled water surface W when supplying water to the tank in a toilet-clogged state of the flush toilet according to the embodiment of the present invention.

Next, as shown in FIG. 13B, upon reaching the dead water level (DWL), the pooled water surface W has further risen as compared to during standby described above. At this point, the dead water level is at a position higher than the normal position of the dead water level as described above. Therefore, the water level difference between the dead water level DWL of the flush water of the reservoir tank 4 and the pooled water surface W is ΔH5 which is a small value and the dead water level DWL and the pooled water surface W are in a state of equilibrium. However, as will be described later, since specific gravity of the jet discharge valve 38 is approximately 1.3 and the jet discharge valve 38 closes by its own weight even if a state of equilibrium is created, the pooled water of the pooled water surface W does not flow backward to the reservoir tank 4.

Next, as shown in FIG. 13C, the pooled water surface W has risen considerably even when supplying water to the tank. However, since the water level of the reservoir tank 4 is the stopped water level WL0 and, furthermore, the stopped water level WL0 is higher than the upper surface of the bowl due to supplying water to the tank, even when an opening operation of the jet discharge valve 38 is performed in this state, the pooled water of the pooled water surface W does not flow backward to the reservoir tank 4.

Figure 14:
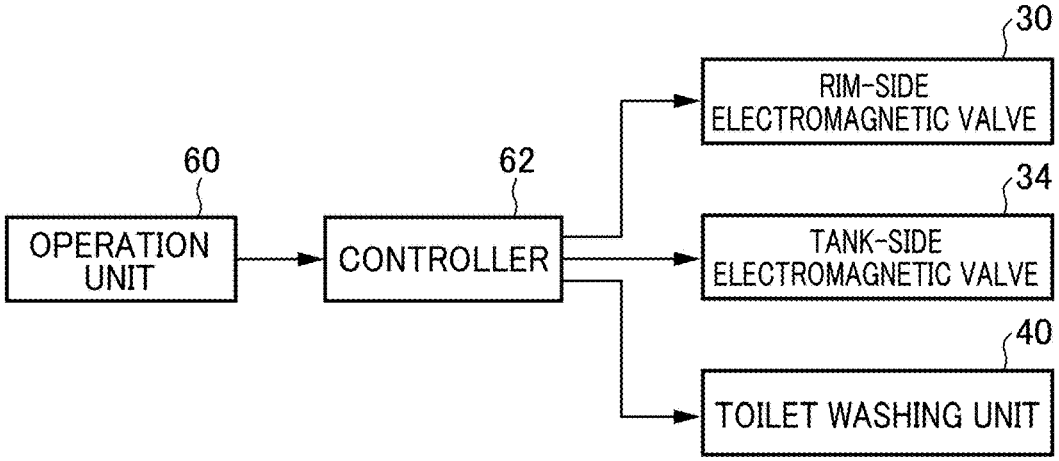
FIG. 14 is a block diagram showing contents of control by a controller of the flush toilet according to the embodiment of the present invention.

Next, contents of control for supplying water to the reservoir tank and draining water from the reservoir tank in the flush toilet according to the present embodiment will be described with reference to FIG. 14. FIG. 14 is a block diagram showing contents of control by a controller of the flush toilet according to the present embodiment.

As shown in FIG. 14, when an operation unit 60 is operated by a user, an operation signal of the operation unit 60 is sent to a controller 62. When the operation signal is related to starting or stopping rim spouting, an opening operation or a closing operation of the rim-side electromagnetic valve 30 is performed and the rim spouting is started or stopped.

When the operation signal is related to supplying water to the reservoir tank, an opening operation or a closing operation of the tank-side electromagnetic valve 34 is performed and supply of water to the reservoir tank 4 is started or stopped.

When the operation signal is related to an opening operation or a closing operation of the jet discharge valve 38, an opening operation or a closing operation of the jet discharge valve 38 is performed by the toilet washing unit 40.

Next, operational effects produced by the flush toilet according to the embodiment of the present invention described above will be described.

With the flush toilet 1 according to the present embodiment, since the flush water is supplied to the jet water conduit 16 to reduce air A that exists between the jet spouting discharge valve 38 and an upper part of the jet water conduit 16 before opening the jet spouting discharge valve 38, the pressure loss which occurs due to the air flowing out from the jet spout port 14 when the flush water is supplied from the reservoir tank 4 to the jet water conduit 16 can be reduced.

In the flush toilet 1 according to the present embodiment, since sequence control performed so that flush water is sequentially and successively spouted from the rim spout port 10 as "early rim spouting", "middle rim spouting", and "late rim spouting" and spouted from the jet spout port 14 as "jet spouting" when "middle rim spouting" is being performed causes the flush water supplied to the bowl 6 by the early rim spouting and pooled water remaining in the bowl 6 due to the late rim spouting during a previous flush to join the flush water due to the jet spouting, a siphon action can be generated due to flush water with a large flow rate flowing into the discharge trap conduit 8 and the siphon action can be continued by the flush water due to the subsequent jet spouting and the flush water due to the subsequent middle rim spouting. As a result, according to the present embodiment, even when flush water is supplied to the jet water conduit 16 by head pressure of the flush water of the reservoir tank 4 which has a low silhouette and of which a capacity is limited, waste can be reliably discharged by a strong siphon action and water conservation can be achieved.

With the flush toilet 1 according to the present embodiment, since the opening operation of the jet discharge valve 38 is performed after a water level of the jet water conduit 16 rises to a vicinity of the jet discharge valve 38 and air A is exhausted, a pressure loss due to air can be reduced when the flush water is spouted from the jet spout port 14.

With the flush toilet 1 according to the present embodiment, since the spouting time of the early rim spouting is shorter than the spouting time of the late rim spouting, the bowl 6 can be flushed by the early rim spouting of which a flush water amount is smaller than the flush water of the late rim spouting and a siphon action can be generated by the flush water.

In the flush toilet 1 according to the present embodiment, supply of water to the reservoir tank 4 by the tank-side electromagnetic valve 34 or an opening operation of the jet spouting discharge valve 38 by the toilet washing unit 40 is to be executed by the controller 62 during a flush operation so that a tank water level in the reservoir tank 4 is positioned higher than a water level of the pooled water surface W of the bowl 6.

Accordingly, with the flush toilet 1 according to the present embodiment, even when waste becomes clogged in the discharge trap conduit 8 during a flush operation and a state of equilibrium is created between the tank water level and the risen water level of the pooled water surface W, wastewater can be prevented from flowing backward from the bowl 6 to the reservoir tank 4.

In the flush toilet 1 according to the present embodiment, when the water level of the bowl 6 rises due to clogging of waste or the like, the controller 62 shortens an opening time of the jet spouting discharge valve 38 so that the flow rate of the flush water that is drained from the reservoir tank 4 is reduced, the water level in the reservoir tank 4 becomes less apt to drop and becomes higher than the water level of the bowl 6 and, accordingly, a backward flow can be prevented.

With the flush toilet 1 according to the present embodiment, the overflow pipe (exhaust pipe) 36 can effectively exhaust air A remaining between the jet spouting discharge valve 38 and a water surface of the jet water conduit 16. Furthermore, since the air A is exhausted from the overflow pipe 36 into the reservoir tank 4 and air which flows out to the seal water surface (pooled water surface) W of the bowl 6 as air bubbles can be reduced, a flush is not adversely affected by the air bubbles.

With the flush toilet 1 according to the present embodiment, since flush water is spouted from the rim spout port 10 to raise the water level of the bowl 6 so that the flush water is supplied to the jet water conduit 16 before an opening operation of the jet discharge valve 38 of the reservoir tank 4 is performed, the bowl 6 can be flushed with the flush water spouted from the rim spout port 10 and flush water can be supplied to the jet water conduit 16 utilizing the fact that the water level of the bowl 6 is raised by the flush water after the flush. Furthermore, since the flush water in the bowl 6 can be used, water conservation can also be achieved. In addition, since the flush water is supplied from the bowl 6 to the jet water conduit 16, the air A more readily escapes from the overflow pipe 36 and, as a result, a smaller amount of air bubbles are exhausted to the bowl 6 and the air bubbles become less conspicuous to a user.

With the flush toilet 1 according to the present embodiment, since the total spouting time of the early rim spouting and the middle rim spouting is shorter than the spouting time of the late rim spouting, a siphon action can be generated and continued by the early rim spouting and the middle rim spouting of which a flush water amount is smaller than the flush water due to the late rim spouting together with jet spouting.

With the flush toilet 1 according to the present embodiment, since the stopped water level (WL0) of the flush water in the reservoir tank 4 is set higher than the upper surface of the bowl 6, large head pressure can be produced.

With the flush toilet 1 according to the present embodiment, since the stopped water level (WL0) of the flush water in the reservoir tank is set lower than the upper surface of the bowl, the height of the reservoir tank 4 can be lowered and a lower silhouette can be achieved.

In the flush toilet 1 according to the present embodiment, specific gravity of the jet discharge valve 38 is set to approximately 1.3. In addition, the specific gravity of the jet spouting discharge valve 38 preferably ranges from 1.2 to 1.4.

In this manner, by setting the specific gravity of the jet discharge valve so as to range from 1.2 to 1.4 (including 1.3), since the jet spouting discharge valve 38 closes by its own weight even when the water level of the bowl 6 rises and a state is created where the water level in the reservoir tank 4 is nearly in equilibrium with the water level of the bowl 6, wastewater can be prevented from flowing backward from the bowl 6 into the reservoir tank 4.

In the flush toilet 1 according to the present embodiment, since the water level of flush water during standby in the reservoir tank is set higher than the upper surface of the bowl 6, the water level of the bowl during standby never becomes higher than the water level of the flush water in the reservoir tank and a backward flow can be prevented.

In the flush toilet 1 according to the present embodiment, since the instantaneous flow rate of the flush water that is drained from the reservoir tank 4 becomes lower when a water level difference between the water level of the bowl 6 and the water level of the reservoir tank 4 decreases by setting the pull-up time of the jet discharge valve 38 to a predetermined fixed value, the water level in the reservoir tank 4 becomes less apt to drop and becomes higher than the water level of the bowl 6 and, accordingly, wastewater can be prevented from flowing backward from the bowl 6 into the reservoir tank 4.

For example, when a large amount of waste is discharged while being clogged and a siphon action is broken after the flush water is replenished to the reservoir tank 4, a seal water position may become lower. When a jet flows out from the jet spout port 14 in a state where the seal water position has become lower, air trapped in the jet water conduit 16 is ejected from the jet spout port 14 and water splashing occurs in which the air pushes out flush water.

With the flush toilet 1 according to the present embodiment, when the seal water position is lower than a predetermined seal water level, since the flush water (seal water) is replenished to the bowl 6 to raise the seal water position or to raise the seal water position to a vicinity of the predetermined seal water level and jet spouting is performed in this state, a situation where air trapped in the jet water conduit 16 is ejected from the jet spout port 14 and water splashing occurs in which the air pushes out flush water can be prevented.

With the flush toilet 1 according to the present embodiment, since the seal water position is estimated using existing tank water level detecting means such as the float switch 28, there is no need to newly provide a sensor for detection or the like.

With the flush toilet 1 according to the present embodiment, the bowl surface of the bowl 6 can be flushed by performing rim spouting before jet spouting and, furthermore, the flush water due to the rim spouting can be used to replenish the seal water.

With the flush toilet 1 according to the present embodiment, since the seal water can be replenished using the existing overflow pipe 36, a mechanism for replenishing the seal water can be simplified.

REFERENCE SIGNS LIST

1 flush toilet
2 toilet main body
4 reservoir tank
6 bowl
8 discharge trap conduit
8*a* inlet
8*b* ascending conduit
8*c* descending conduit
8*d* top portion
10 rim spout port
14 jet spout port
16 jet water conduit
18 waste receiving surface
20 rim
24 water supply device
26 discharge device
28 float switch
29, 62 controller
30 rim-side electromagnetic valve
32 tank water supply port
34 tank-side electromagnetic valve
36, 52 overflow pipe (air exhaust pipe)
38, 50 jet spouting discharge valve
40 toilet washing unit
46 water level sensor
60 operation unit
W seal water surface (pooled water surface)
W1 seal water position
WL0 stopped water level
DWL dead water level
A air

What is claimed is:

1. A siphon jet flush toilet comprising:

a bowl including a waste receiving surface and a rim formed along a top edge portion of the waste receiving surface;

a rim spout port formed in the rim, said rim spout port spouting flush water to the bowl;

a discharge trap conduit connected to a bottom portion of the bowl, said discharge trap conduit including an ascending conduit that extends upward from the bottom portion of the bowl, a descending conduit that extends downward from the ascending conduit, and a top portion that is positioned between the ascending conduit and the descending conduit and that regulates a seal water level;

a jet spout port arranged in the bottom portion of the bowl so as to spout flush water toward an inlet of the discharge trap conduit;

a reservoir tank including a jet spouting discharge valve, said reservoir tank storing flush water to be supplied to the jet spout port;

a jet water conduit being configured to connect the reservoir tank and the jet spout port, said jet water conduit guiding the flush water in the reservoir tank to the jet spout port due to head pressure of the flush water in the reservoir tank; and a controller being configured to control a rim spouting in which the flush water is spouted from the rim spout port and a jet spouting in which the flush water is spouted from the jet spout port, wherein the jet spouting discharge valve including a valve body, said valve body being arranged at a position that is lower than an upper surface of the bowl and higher than the seal water level, and before opening the jet spouting discharge valve, the flush water is supplied to the jet water conduit so as to reduce air that exists between the valve body of the jet spouting discharge valve and a water surface of the jet water conduit.

2. The flush toilet according to claim 1, wherein the controller controls flush water to be sequentially and successively spouted from the rim spout port as "early rim spouting", "middle rim spouting", and "late rim spouting" and to be spouted from the jet spout port as "jet spouting" when "middle rim spouting" is being performed.

3. The flush toilet according to claim 2, wherein a spouting time of the early rim spouting is shorter than a spouting time of the late rim spouting.

4. The flush toilet according to claim 2, wherein a total spouting time of the early rim spouting and the middle rim spouting is shorter than the spouting time of the late rim spouting.

5. The flush toilet according to claim 2, wherein the stopped water level of flush water in the reservoir tank is set higher than the upper surface of the bowl.

6. The flush toilet according to claim 2, wherein the stopped water level of flush water in the reservoir tank is set lower than the upper surface of the bowl.

7. The flush toilet according to claim 1, wherein after flush water is supplied to the jet water conduit, a water level of the jet water conduit rises to a vicinity of the jet spouting discharge valve, and air is exhausted, the controller performs an opening operation of the jet spouting discharge valve.

8. The flush toilet according to claim 7, wherein flush water is spouted from the rim spout port to raise the water level of the bowl so that flush water is supplied to the jet water conduit before the controller performs an opening operation of the jet spouting discharge valve of the reservoir tank.

9. The flush toilet according to claim 1, wherein the controller executes a water supply operation to the reservoir tank or an opening operation of the jet spouting discharge valve during a flush operation so that a tank water level in the reservoir tank is at a higher position than a water level of a pooled water surface of the bowl.

10. The flush toilet according to claim 9, wherein when the water level of the bowl rises, the controller performs an opening operation of the jet spouting discharge valve so that a flow rate of the flush water being discharged from the reservoir tank is reduced.

11. The flush toilet according to claim 10, wherein an instantaneous flow rate of flush water that is discharged from the reservoir tank is lowered by setting a pull-up time of the jet spouting discharge valve to a predetermined fixed value.

12. The flush toilet according to claim 9, wherein specific gravity of the jet spouting discharge valve ranges from 1.2 to 1.4.

13. The flush toilet according to claim 9, wherein a water level of flush water during standby in the reservoir tank is set higher than the upper surface of the bowl.

14. The flush toilet according to claim 1, further comprising an air exhaust pipe extending higher than a stopped water level in the reservoir tank from lower than the valve body of the jet spouting discharge valve.

15. The flush toilet according to claim 1, wherein seal water with a predetermined seal water level is formed in a lower part of the bowl, the flush toilet further comprises a detecting device configured to detect the seal water position, the jet spout port is positioned in the seal water, and when the seal water position is lower than the predetermined seal water level, the flush water is replenished to the bowl to raise the seal water position and jet spouting is performed in this state.

16. The flush toilet according to claim 15, wherein the detecting device which detects the seal water position is a tank water level detecting device detecting a water level of the reservoir tank, and the seal water position is estimated based on a value of a dead water level detected by the tank water level detecting device, a value of the stopped water level, or a water supply time to the reservoir tank required to reach the stopped water level.

17. The flush toilet according to claim 16, wherein the tank water level detecting device is a float switch which detects a stopped water level of the reservoir tank.

18. The flush toilet according to claim 15, wherein the seal water is replenished by performing rim spouting before performing jet spouting.

19. The flush toilet according to claim 15, wherein an overflow pipe configured to discharge the flush water in the reservoir tank to the jet water conduit when a water supply time to the reservoir tank required by the water level in the reservoir tank to rise to the stopped water level becomes prolonged is further provided in the reservoir tank, and seal water is replenished by replenishing the flush water in the reservoir tank and causing the flush water to flow out from the overflow pipe to the jet water conduit.

* * * * *